US012078409B2

(12) United States Patent
Jung et al.

(10) Patent No.: US 12,078,409 B2
(45) Date of Patent: Sep. 3, 2024

(54) VACUUM ADIABATIC BODY AND REFRIGERATOR

(71) Applicant: LG ELECTRONICS INC., Seoul (KR)

(72) Inventors: Wonyeong Jung, Seoul (KR); Deokhyun Youn, Seoul (KR); Daewoong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 344 days.

(21) Appl. No.: 16/710,720

(22) Filed: Dec. 11, 2019

(65) Prior Publication Data

US 2020/0116421 A1 Apr. 16, 2020

Related U.S. Application Data

(63) Continuation of application No. 15/749,142, filed as application No. PCT/KR2016/008514 on Aug. 2, 2016, now Pat. No. 10,584,914.

(30) Foreign Application Priority Data

Aug. 3, 2015 (KR) ..... 10-2015-0109623

(51) Int. Cl.
*F25B 13/00* (2006.01)
*F25D 23/02* (2006.01)
(Continued)

(52) U.S. Cl.
CPC ..... *F25D 23/066* (2013.01); *F25B 13/00* (2013.01); *F25D 23/02* (2013.01); *F25D 23/028* (2013.01);
(Continued)

(58) Field of Classification Search
CPC ..... F25D 23/006; F25D 13/00; F25D 23/02; F25D 23/028; F25D 23/06; F25D 23/087; F25D 2201/14
See application file for complete search history.

(56) References Cited

U.S. PATENT DOCUMENTS 1,413,169 A 4/1922 Lawton
1,588,707 A 6/1926 Csiga
(Continued)

FOREIGN PATENT DOCUMENTS

CN 1132346 10/1996
CN 1191959 9/1998
(Continued)

OTHER PUBLICATIONS

U.S. Appl. No. 15/749,132, filed Jan. 31, 2018.
(Continued)

*Primary Examiner* — Nael N Babaa
(74) *Attorney, Agent, or Firm* — KED & ASSOCIATES, LLP

(57) ABSTRACT

A vacuum adiabatic body includes a first plate; a second plate; a seal; a support; a heat resistance unit; and an exhaust port, wherein the heat resistance unit includes a conductive resistance sheet connected to the first plate, the conductive resistance sheet resisting heat conduction flowing along a wall for the third space, the conductive resistance sheet includes a shielding part for heat-insulating the conductive resistance sheet by shielding a first surface of the conductive resistance sheet, and a second surface of the conductive resistance sheet is heat-insulated by the third space.

15 Claims, 11 Drawing Sheets

(51) Int. Cl.
*F25D 23/06* (2006.01)
*F25D 23/08* (2006.01)

(52) U.S. Cl.
CPC ..... *F25D 23/06* (2013.01); *F25D 23/087* (2013.01); *F25D 2201/14* (2013.01)

(56) References Cited

U.S. PATENT DOCUMENTS 1,845,353 A 2/1932 Snell
2,000,882 A 5/1935 Comstock
2,708,774 A 5/1955 Seelen
2,715,976 A 8/1955 Whitmore
2,729,863 A 1/1956 Kurtz
2,768,046 A 10/1956 Evans
2,786,241 A 3/1957 Garvey et al.
3,091,946 A 6/1963 Kesling
3,161,265 A 12/1964 Matsch et al.
3,289,423 A 12/1966 Berner et al.
3,370,740 A 2/1968 Anderson
3,520,581 A 7/1970 Borghi
4,056,211 A 11/1977 Zumwalt
4,646,934 A 3/1987 McAllister
4,822,117 A 4/1989 Boston, Jr.
4,959,111 A 9/1990 Kruck et al.
5,011,729 A 4/1991 McAllister
5,018,328 A 5/1991 Cur
5,033,803 A 7/1991 Katsuyoshi et al.
5,185,981 A 2/1993 Martinez
5,200,015 A 4/1993 Schilf
5,361,598 A 11/1994 Roseen
5,512,345 A 4/1996 Tsutsumi et al.
5,532,034 A 7/1996 Kirby et al.
5,694,789 A 12/1997 Do
5,795,639 A 8/1998 Lin
5,843,353 A 12/1998 De Vos et al.
5,947,479 A 9/1999 Ostrowski
6,001,890 A 12/1999 Hamilton
6,029,846 A 2/2000 Hirath et al.
6,038,830 A 3/2000 Hirath et al.
6,109,712 A 8/2000 Haworth et al.
6,168,040 B1 1/2001 Sautner et al.
6,192,703 B1 2/2001 Salyer et al.
6,244,458 B1 6/2001 Frysinger et al.
6,338,536 B1 1/2002 Ueno et al.
6,485,122 B2 11/2002 Wolf
8,383,225 B2 2/2013 Rotter
8,857,931 B2 10/2014 Jung et al.
8,881,398 B2 11/2014 Hanley et al.
8,943,770 B2 2/2015 Sanders
8,944,541 B2 2/2015 Allard
9,182,158 B2 11/2015 Wu
9,328,951 B2 5/2016 Shin
9,441,779 B1 9/2016 Alshourbagy et al.
9,463,918 B2 10/2016 Reid
9,752,818 B2 9/2017 Naik
9,791,204 B2 10/2017 Kim
9,945,600 B2 4/2018 Kang
10,082,328 B2 9/2018 Jung et al.
2002/0041134 A1 4/2002 Wolf et al.
2002/0100250 A1 8/2002 Hirath et al.
2002/0170265 A1 11/2002 Tokonabe et al.
2003/0080126 A1 5/2003 Voute et al.
2003/0115838 A1 6/2003 Rouanet et al.
2003/0207075 A1 11/2003 Maignan et al.
2004/0051427 A1 3/2004 Cittadini et al.
2004/0091688 A1 5/2004 Gaku
2004/0226956 A1 11/2004 Brooks
2005/0175809 A1 8/2005 Hirai et al.
2005/0235682 A1 10/2005 Hirai et al.
2007/0152551 A1 7/2007 Kim
2007/0204648 A1 9/2007 Smale et al.
2007/0243358 A1 10/2007 Gandini
2008/0110128 A1 5/2008 Hirath
2008/0289898 A1 11/2008 Rickards
2009/0031659 A1 2/2009 Kalfon
2009/0113899 A1 5/2009 Dain
2010/0104923 A1 4/2010 Takeguchi et al.
2010/0178439 A1 7/2010 Bettger et al.
2011/0089802 A1 4/2011 Cording
2011/0146333 A1* 6/2011 Koo ..... F25D 23/04 62/441
2011/0296797 A1 12/2011 Stark et al.
2012/0103006 A1 5/2012 Jung et al.
2012/0104923 A1 5/2012 Jung et al.
2012/0118002 A1 5/2012 Kim et al.
2012/0125039 A1 5/2012 Hwang
2012/0128920 A1 5/2012 Yoon et al.
2012/0231204 A1 9/2012 Jeon et al.
2012/0269996 A1 10/2012 Jäger
2012/0326587 A1 12/2012 Jeong et al.
2013/0008309 A1 1/2013 Hashida
2013/0026900 A1 1/2013 Oh et al.
2013/0099650 A1 4/2013 Lee et al.
2013/0105494 A1 5/2013 Jung
2013/0105496 A1 5/2013 Jung
2013/0195544 A1 8/2013 Sanders et al.
2013/0255304 A1 10/2013 Cur et al.
2013/0257257 A1 10/2013 Cur
2013/0293080 A1 11/2013 Kim et al.
2014/0103791 A1* 4/2014 Cheon ..... F25D 21/04 312/405
2014/0132142 A1 5/2014 Kim et al.
2014/0216100 A1 8/2014 Toshimitsu et al.
2014/0272208 A1 9/2014 Song et al.
2014/0315011 A1 10/2014 Lee et al.
2014/0346942 A1 11/2014 Kim et al.
2015/0030800 A1 1/2015 Jung et al.
2015/0068401 A1 3/2015 Hashida
2015/0192356 A1 7/2015 Kang et al.
2015/0360842 A1 12/2015 Bessho et al.
2016/0109172 A1 4/2016 Kim et al.
2016/0356542 A1 12/2016 Kim et al.
2017/0325634 A1 11/2017 Cai et al.
2018/0266620 A1 9/2018 Kawarazaki et al.
2018/0299060 A1 10/2018 Song et al.
2018/0313492 A1 11/2018 Kitano et al.
2019/0101320 A1 4/2019 Dherde et al.
2019/0128593 A1 5/2019 Deka et al.

FOREIGN PATENT DOCUMENTS

CN 1276052 12/2000
CN 1286386 3/2001
CN 1515857 7/2004
CN 1576678 2/2005
CN 2700790 5/2005
CN 1666071 9/2005
CN 2748848 12/2005
CN 1731053 2/2006
CN 1820173 8/2006
CN 1896657 1/2007
CN 101072968 11/2007
CN 101171472 4/2008
CN 101349493 A 1/2009
CN 201191121 2/2009
CN 201428906 3/2010
CN 201764779 3/2011
CN 102032736 4/2011
CN 201811526 4/2011
CN 102099646 6/2011
CN 102116402 7/2011
CN 102261470 11/2011
CN 102455103 5/2012
CN 102455104 5/2012
CN 102455105 5/2012
CN 102735013 10/2012
CN 102818421 12/2012
CN 102840729 12/2012
CN 102927740 2/2013
CN 103062981 4/2013
CN 103090615 5/2013
CN 103090616 5/2013
CN 103154648 6/2013
CN 103189696 7/2013

(56) References Cited

FOREIGN PATENT DOCUMENTS

| | | | |
|---|---|---|---|
| CN | 103228851 | | 7/2013 |
| CN | 203095854 | | 7/2013 |
| CN | 103363764 | | 10/2013 |
| CN | 103370587 | A | 10/2013 |
| CN | 103542660 | | 1/2014 |
| CN | 103575038 | | 2/2014 |
| CN | 103649658 | | 3/2014 |
| CN | 103968196 | | 8/2014 |
| CN | 104180595 | | 12/2014 |
| CN | 104204646 | | 12/2014 |
| CN | 104254749 | | 12/2014 |
| CN | 104344653 | | 2/2015 |
| CN | 104457117 | A | 3/2015 |
| CN | 104482707 | | 4/2015 |
| CN | 104567215 | | 4/2015 |
| CN | 104634047 | | 5/2015 |
| CN | 104729201 | | 6/2015 |
| CN | 104746690 | | 7/2015 |
| CN | 105546923 | | 5/2016 |
| CN | 108354755 | | 8/2018 |
| DE | 956 899 | | 1/1957 |
| DE | 28 02 910 | | 8/1978 |
| DE | 29 39 878 | | 4/1981 |
| DE | 31 21 351 | | 12/1982 |
| DE | 9204365 | | 7/1992 |
| DE | 197 45 825 | | 4/1999 |
| DE | 1 980 3908 | | 8/1999 |
| DE | 299 12 917 | | 11/1999 |
| DE | 199 07 182 | | 8/2000 |
| DE | 10-2011-050473 | | 11/2011 |
| DE | 10 2011 014 302 | | 9/2012 |
| DE | 10 2011 079 209 | | 1/2013 |
| DE | 10-2012-100490 | | 7/2013 |
| DE | 10-2012-223539 | | 6/2014 |
| EP | 0 071 090 | | 2/1983 |
| EP | 0 658 716 | | 6/1995 |
| EP | 0 658 733 | | 6/1995 |
| EP | 0 892 120 | | 1/1999 |
| EP | 1 477 752 | | 11/2004 |
| EP | 1 484 563 | | 12/2004 |
| EP | 1 614 954 | | 1/2006 |
| EP | 2 333 179 | | 6/2011 |
| EP | 2 447 639 | | 5/2012 |
| EP | 2 806 239 | | 11/2014 |
| EP | 2 824 405 | | 1/2015 |
| EP | 2 829 827 | | 1/2015 |
| EP | 2 936 013 | | 10/2015 |
| EP | 2 952 838 | | 12/2015 |
| EP | 2 952 839 | | 12/2015 |
| EP | 2 789 951 | | 10/2020 |
| GB | 890372 | | 2/1962 |
| GB | 2 446 053 | | 7/2008 |
| JP | H04-341694 | | 11/1992 |
| JP | H05-10494 | | 1/1993 |
| JP | H07-234067 | | 9/1995 |
| JP | H09-145241 | | 6/1997 |
| JP | 11-211334 | | 8/1999 |
| JP | H11335114 | | 12/1999 |
| JP | 2002-243091 | A | 8/2002 |
| JP | 2003-106760 | | 4/2003 |
| JP | 2003-269688 | | 9/2003 |
| JP | 2004-044980 | | 2/2004 |
| JP | 2004-196411 | | 7/2004 |
| JP | 2005-214372 | | 8/2005 |
| JP | 2007-218509 | | 8/2007 |
| JP | 2008-045580 | | 2/2008 |
| JP | 2008-249003 | | 10/2008 |
| JP | 2009-078261 | A | 4/2009 |
| JP | 2010-008011 | | 1/2010 |
| JP | 2010008011 | A | 1/2010 |
| JP | 2012-087993 | | 5/2012 |
| JP | 2012-255607 | | 12/2012 |
| JP | 2013-119966 | A | 6/2013 |
| JP | 2014-037931 | | 2/2014 |
| KR | 10-2001-0073363 | | 8/2001 |
| KR | 10-0343719 | | 7/2002 |
| KR | 10-0411841 | | 12/2003 |
| KR | 10-2005-0065088 | | 6/2005 |
| KR | 20070052156 | A | 5/2007 |
| KR | 10-2009-0111632 | | 10/2009 |
| KR | 10-2010-0097410 | | 9/2010 |
| KR | 10-2010-0099629 | | 9/2010 |
| KR | 10-2010-0119937 | | 11/2010 |
| KR | 10-2010-0136614 | | 12/2010 |
| KR | 10-2011-0015322 | | 2/2011 |
| KR | 10-2011-0015325 | | 2/2011 |
| KR | 10-2011-0051327 | | 2/2011 |
| KR | 10-1041086 | | 6/2011 |
| KR | 10-2011-0100440 | | 9/2011 |
| KR | 10-2012-0044558 | | 5/2012 |
| KR | 10-2012-0139648 | | 12/2012 |
| KR | 10-1227516 | | 1/2013 |
| KR | 10-2013-0048528 | | 5/2013 |
| KR | 10-2013-0048530 | | 5/2013 |
| KR | 10-2013-0054213 | | 5/2013 |
| KR | 10-2014-0129552 | | 11/2014 |
| KR | 10-2015-0012712 | | 2/2015 |
| KR | 10-1506413 | | 3/2015 |
| NL | 1005962 | | 11/1998 |
| RU | 129188 | | 6/2013 |
| WO | WO 93/25843 | | 12/1993 |
| WO | WO 2006/003199 | | 1/2006 |
| WO | WO 2011/016693 | | 2/2011 |
| WO | WO 2012/084874 | | 6/2012 |
| WO | WO 2012/176880 | | 12/2012 |
| WO | WO 2013/007568 | | 1/2013 |
| WO | WO 2014/049969 | | 4/2014 |
| WO | WO 2014/175639 | | 10/2014 |
| WO | WO 2016/208193 | A1 | 12/2016 |
| WO | WO 2017/023095 | | 2/2017 |
| WO | WO 2017/192121 | | 11/2017 |
| WO | WO 2018/044274 | | 3/2018 |

OTHER PUBLICATIONS

U.S. Appl. No. 15/749,139, filed Jan. 31, 2018.
U.S. Appl. No. 15/749,136, filed Jan. 31, 2018.
U.S. Appl. No. 15/749,143, filed Jan. 31, 2018.
U.S. Appl. No. 15/749,146, filed Jan. 31, 2018.
U.S. Appl. No. 15/749,156, filed Jan. 31, 2018.
U.S. Appl. No. 15/749,162, filed Jan. 31, 2018.
U.S. Appl. No. 15/749,140, filed Jan. 31, 2018.
U.S. Appl. No. 15/749,142, filed Jan. 31, 2018.
U.S. Appl. No. 15/749,147, filed Jan. 31, 2018.
U.S. Appl. No. 15/749,149, filed Jan. 31, 2018.
U.S. Appl. No. 15/749,179, filed Jan. 31, 2018.
U.S. Appl. No. 15/749,154, filed Jan. 31, 2018.
U.S. Appl. No. 15/749,161, filed Jan. 31, 2018.
Korean Office Action dated Jun. 5, 2020 issued in KR Application No. 10-2017-0093784.
European Search Report dated Jul. 10, 2020 issued in EP Application No. 20168389.3.
United States Office Action dated Sep. 1, 2020 issued in U.S. Appl. No. 15/749,156.
Australian Office Action dated Nov. 13, 2020 issued in AU Application No. 2020200641.
International Search Report and Written Opinion dated Oct. 12, 2016 issued in Application No. PCT/KR2016/008465.
International Search Report and Written Opinion dated Oct. 12, 2016 issued in Application No. PCT/KR2016/008507.
International Search Report and Written Opinion dated Nov. 21, 2016 issued in Application No. PCT/KR2016/008466.
International Search Report and Written Opinion dated Nov. 21, 2016 issued in Application No. PCT/KR2016/008468.
International Search Report and Written Opinion dated Nov. 21, 2016 issued in Application No. PCT/KR2016/008469.
International Search Report and Written Opinion dated Nov. 21, 2016 issued in Application No. PCT/KR2016/008470.
International Search Report and Written Opinion dated Nov. 21, 2016 issued in Application No. PCT/KR2016/008501.

(56) References Cited

OTHER PUBLICATIONS

International Search Report and Written Opinion dated Nov. 21, 2016 issued in Application No. PCT/KR2016/008502.
International Search Report and Written Opinion dated Nov. 21, 2016 issued in Application No. PCT/KR2016/008505.
International Search Report and Written Opinion dated Nov. 21, 2016 issued in Application No. PCT/KR2016/008519.
International Search Report and Written Opinion dated Nov. 21, 2016 issued in Application No. PCT/KR2016/008523.
International Search Report and Written Opinion dated Dec. 7, 2016 issued in Application No. PCT/KR2016/008516.
International Search Report and Written Opinion dated Dec. 23, 2016 issued in Application No. PCT/KR2016/008512.
International Search Report and Written Opinion dated Dec. 23, 2016 issued in Application No. PCT/KR2016/008514.
Russian Office Action dated Sep. 25, 2018 issued in RU Application No. 2018107646.
European Search Report dated Dec. 21, 2018 issued in EP Application No. 16833330.0.
European Search Report dated Feb. 13, 2019 issued in EP Application No. 16833309.4.
European Search Report dated Feb. 13, 2019 issued in EP Application No. 16833311.0.
European Search Report dated Feb. 20, 2019 issued in EP Application No. 16833313.6.
European Search Report dated Feb. 22, 2019 issued in EP Application No. 16833312.8.
European Search Report dated Feb. 26, 2019 issued in EP Application No. 16833324.3.
European Search Report dated Feb. 26, 2019 issued in EP Application No. 16833336.7.
European Search Report dated Mar. 1, 2019 issued in EP Application No. 16833323.5.
European Search Report dated Mar. 1, 2019 issued in EP Application No. 16833338.3.
European Search Report dated Mar. 13, 2019 issued in EP Application No. 16833331.8.
European Search Report dated Mar. 15, 2019 issued in EP Application No. 16833326.8.
European Search Report dated Apr. 3, 2019 issued in EP Application No. 16833325.0.
U.S. Office Action dated Jun. 13, 2019 issued in related U.S. Appl. No. 15/749,139.
U.S. Office Action dated Jun. 13, 2019 issued in related U.S. Appl. No. 15/749,136.
United States Office Action dated Sep. 20, 2019 issued in U.S. Appl. No. 15/749,149.
U.S. Office Action dated Oct. 4, 2019 issued in related U.S. Appl. No. 15/749,140.
Chinese Office Action (with English translation) dated Jul. 15, 2019 issued in CN Application No. 201680045949.0.
Chinese Office Action (with English translation) dated Aug. 5, 2019 issued in CN Application No. 201680045869.5.
Chinese Office Action (with English translation) dated Aug. 5, 2019 issued in CN Application No. 201680045899.6.
Chinese Office Action (with English translation) dated Aug. 5, 2019 issued in CN Application No. 201680045908.1.
Chinese Office Action (with English translation) dated Aug. 5, 2019 issued in CN Application No. 201680045935.9.
Chinese Office Action (with English translation) dated Aug. 5, 2019 issued in CN Application No. 201680046042.6.
Chinese Office Action (with English translation) dated Aug. 5, 2019 issued in CN Application No. 201680046048.3.
Chinese Office Action (with English translation) dated Aug. 13, 2019 issued in CN Application No. 201680045950.3.
Chinese Office Action (with English translation) dated Sep. 19, 2019 issued in CN Application No. 201680045897. 7.
Chinese Office Action (with English translation) dated Sep. 19, 2019 issued in CN Application No. 201680045898.1.
Chinese Office Action (with English translation) dated Sep. 19, 2019 issued in CN Application No. 201680046047.9.
U.S. Office Action dated Oct. 17, 2019 issued in U.S. Appl. No. 15/749,147.
U.S. Office Action dated Oct. 17, 2019 issued in U.S. Appl. No. 15/749,143.
U.S. Office Action dated Oct. 17, 2019 issued in U.S. Appl. No. 15/749,162.
United States Office Action dated Dec. 10, 2019 issued in U.S. Appl. No. 15/749,132.
Chinese Office Action dated Dec. 3, 2021 issued in CN Application No. 202110032077.7.
European Search Report dated Feb. 8, 2022 issued in EP Application No. 21203498.7.
Chinese Office Action dated Feb. 15, 2022 issued in CN Application No. 202010671000.X.
Chinese Office Action dated Feb. 18, 2022 issued in CN Application No. 202010975466.9.
United States Office Action dated Apr. 15, 2020 issued in U.S. Appl. No. 15/749,136.
United States Notice of Allowance dated Apr. 15, 2020 issued in U.S. Appl. No. 15/749,140.
U.S. Appl. No. 16/942,262, filed Jul. 29, 2020.
Chinese Office Action dated Apr. 6, 2021 issued in CN Application No. 202010248772.2.
Chinese Office Action dated Apr. 6, 2021 issued in CN Application No. 202010248789.8.
Chinese Office Action dated Apr. 6, 2021 issued in CN Application No. 202010248791.5.
Chinese Office Action dated Apr. 8, 2021 issued in CN Application No. 202010248891.8.
Chinese Office Action dated Jun. 2, 2021 issued in CN Application No. 202010634146.7.
Chinese Office Action dated Jun. 23, 2021 issued in CN Application No. 202010669915.7.
United States Office Action dated Jun. 28, 2021 issued in co-pending related U.S. Appl. No. 15/749,156.
European Office Action dated Jan. 11, 2021 issued in Application 16 833 313.6.
U.S. Office Action dated Mar. 31, 2021 issued in co-pending U.S. Appl. 15/749,132.
United States Office Action dated Mar. 25, 2020 issued in U.S. Appl. No. 15/749,156.
European Search Report dated Oct. 11, 2021 issued in EP Application No. 21185349.4.
European Search Report dated Oct. 11, 2021 issued in EP Application No. 21185362.7.
Korean Office Action dated Aug. 1, 2021 issued in KR Application No. 10-2021-0085731.
Chinese Office Action dated Aug. 2, 2021 issued in CN Application No. 202010972409.5.
Chinese Office Action dated Aug. 3, 2021 issued in CN Application No. 202010972419.9.
Chinese Office Action dated Aug. 4, 2021 issued in CN Application No. 202010972442.8.
United States Office Action dated Mar. 27, 2020 issued in U.S. Appl. No. 15/749,149.
Chinese Office Action and Search Report dated Jul. 20, 2021 issued in Application 20101067100.X.
United States Office Action dated Mar. 2, 2022 issued in co-pending related U.S. Appl. No. 17/170,005.
Chinese Office Action dated May 18, 2022 issued in CN Application No. 202110718315.X.
United States Office Action dated Jun. 10, 2022 issued in co-pending related U.S. Appl. No. 16/942,213.
United States Office Action dated Mar. 20, 2020 issued in U.S. Appl. No. 15/749,162.
United States Office Action dated Mar. 24, 2020 issued in U.S. Appl. No. 15/749,154.
United States Office Action dated Feb. 18, 2020 issued in U.S. Appl. No. 15/749,146.
Chinese Office Action dated Jun. 24, 2021 issued in CN Application No. 202010669926.5.

(56) References Cited

OTHER PUBLICATIONS

European Search Report dated Nov. 12, 2020 issued in EP Application No. 20193768.7.
United States Office Action dated Oct. 5, 2021 issued in co-pending related U.S. Appl. No. 16/942,262.
United States Office Action dated Oct. 19, 2021 issued in co-pending related U.S. Appl. No. 17/021,582.
United States Office Action dated Oct. 26, 2021 issued in co-pending related U.S. Appl. No. 16/942,213.
United States Office Action dated Mar. 31, 2022 issued in co-pending related U.S. Appl. No. 16/929,523.
Korean Notice of Allowance dated Jun. 1, 2022 issued in KR Application No. 10-2021-0085731.
European Search Report dated Nov. 3, 2022 issued in EP Application No. 22151005.0.
United States Office Action dated Oct. 6, 2022 issued in co-pending related U.S. Appl. No. 17/072,231.
European Office Action dated Nov. 21, 2022 issued in EP Application No. 20168389.3.
Korean Notice of Allowance dated Nov. 2, 2022 issued in KR Application No. 10-2015-0109720.
United States Office Action dated Jul. 13, 2022 issued in co-pending related U.S. Appl. No. 17/134,911.
United States Office Action dated Jul. 26, 2022 issued in co-pending related U.S. Appl. No. 17/030,806.
United States Office Action dated Nov. 25, 2022 issued in co-pending related U.S. Appl. No. 17/411,659.
United States Office Action dated Jan. 18, 2023 issued in co-pending related U.S. Appl. No. 16/942,213.
Chinese Notice of Allowance dated Jun. 1, 2022 issued in CN Application No. 202110032072.4.
Korean Office Action dated Aug. 8, 2022 issued in KR Application No. 10-2015-0109622.
U.S. Office Action dated Mar. 20, 2023 issued in co-pending related U.S. Appl. No. 17/030,806.
Machine translation of EP 2 952 839.
U.S. Appl. No. 18/095,658, filed May 20, 2022.
U.S. Office Action dated Apr. 27, 2023 issued in U.S. Appl. No. 17/072,231.
U.S. Notice of Allowance dated Mar. 23, 2023 issued in U.S. Appl. No. 16/953,846.
U.S. Appl. No. 17/114,950, filed Dec. 8, 2020.
U.S. Appl. No. 16/942,213, filed Jul. 29, 2020.
U.S. Appl. No. 17/030,806, filed Sep. 24, 2020.
U.S. Appl. No. 16/929,523, filed Jul. 15, 2020.
U.S. Appl. No. 16/710,720, filed Dec. 11, 2019.
U.S. Appl. No. 17/021,582, filed Sep. 15, 2020.
U.S. Appl. No. 17/072,231, filed Oct. 16, 2020.
U.S. Appl. No. 16/953,846, filed Nov. 20, 2020.
U.S. Appl. No. 17/155,430, filed Jan. 22, 2021.
U.S. Appl. No. 17/134,911, filed Dec. 28, 2020.
United States Office Action dated Dec. 22, 2022 issued in co-pending related U.S. Appl. No. 16/953,846.
Korean Office Action dated Jul. 31, 2023 issued in Application 10-2023-0020717.
Chinese Office Action dated Aug. 30, 2023 issued in Application No. 202110718284.8 and English translation.
Korean Office Action dated Nov. 1, 2023 issued in Application 10-2023-0015566.
Chinese Notice of Allowance dated Jun. 1, 2022 issued in CN Application 202110032072.4.
Korean Office Action dated Aug. 8, 2022 issued in KR Application 10-2015-0109622.
Korean Office Action dated Nov. 13, 2023 issued in Application 10-2023-0014241.
U.S. Office Action dated Nov. 22, 2023 issued in U.S. Appl. No. 17/939,507.
U.S. Appl. No. 17/411,659, filed Aug. 25, 2021.
U.S. Appl. No. 18/091,203, filed Dec. 29, 2022.
U.S. Appl. No. 17/170,005, filed Feb. 8, 2021.
U.S. Appl. No. 17/939,507, filed Sep. 7, 2022.
U.S. Appl. No. 17/749,679, filed May 20, 2022.
U.S. Appl. No. 17/582,596, filed Jan. 24, 2022.
U.S. Appl. No. 18/508,279, filed Nov. 14, 2023.
U.S. Appl. No. 18/095,658, filed Jan. 11, 2023.
U.S. Appl. No. 18/237,531, filed Aug. 24, 2023.
U.S. Appl. No. 17/980,088, filed Nov. 3, 2022.
U.S. Appl. No. 18/416,453, filed Jan. 18, 2024.
U.S. Appl. No. 18/091,040, filed Dec. 29, 2022.
U.S. Office Action dated Mar. 18, 2024, issued in U.S. Appl. No. 18/237,531.

* cited by examiner

VACUUM ADIABATIC BODY AND REFRIGERATOR

CROSS REFERENCE TO RELATED PATENT APPLICATIONS

This application is a Continuation of U.S. application Ser. No. 15/749,142, filed Jan. 31, 2018, which is a U.S. National Stage Application under 35 U.S.C. § 371 of PCT Application No. PCT/KR2016/008514, filed Aug. 2, 2016, which claims priority to Korean Patent Application No. 10-2015-0109623, filed Aug. 3, 2015, whose entire disclosures are hereby incorporated by reference.

U.S. application Ser. Nos. 15/749,132; Ser. No. 15/749,139; Ser. No. 15/749,136; Ser. No. 15/749,143; Ser. No. 15/749,146; Ser. No. 15/749,156; Ser. No. 15/749,162; Ser. No. 15/749,140; Ser. No. 15/749,142; Ser. No. 15/749,147; Ser. No. 15/749,149; Ser. No. 15/749,179; Ser. No. 15/749,154; Ser. No. 15/749,161, all filed on Jan. 31, 2018, are related and are hereby incorporated by reference in their entirety. Further, one of ordinary skill in the art will recognize that features disclosed in these above-noted applications may be combined in any combination with features disclosed herein.

TECHNICAL FIELD

The present disclosure relates to a vacuum adiabatic body and a refrigerator.

BACKGROUND ART

A vacuum adiabatic body is a product for suppressing heat transfer by vacuumizing the interior of a body thereof. The vacuum adiabatic body can reduce heat transfer by convection and conduction, and hence is applied to heating apparatuses and refrigerating apparatuses. In a typical adiabatic method applied to a refrigerator, although it is differently applied in refrigeration and freezing, a foam urethane adiabatic wall having a thickness of about 30 cm or more is generally provided. However, the internal volume of the refrigerator is therefore reduced. In order to increase the internal volume of a refrigerator, there is an attempt to apply a vacuum adiabatic body to the refrigerator.

First, Korean Patent No. 10-0343719 (Reference Document 1) of the present applicant has been disclosed. According to Reference Document 1, there is disclosed a method in which a vacuum adiabatic panel is prepared and then built in walls of a refrigerator, and the exterior of the vacuum adiabatic panel is finished with a separate molding such as Styrofoam (polystyrene). According to the method, additional foaming is not required, and the adiabatic performance of the refrigerator is improved. However, manufacturing cost is increased, and a manufacturing method is complicated.

As another example, a technique of providing walls using a vacuum adiabatic material and additionally providing adiabatic walls using a foam filling material has been disclosed in Korean Patent Publication No. 10-2015-0012712 (Reference Document 2). According to Reference Document 2, manufacturing cost is increased, and a manufacturing method is complicated.

As another example, there is an attempt to manufacture all walls of a refrigerator using a vacuum adiabatic body that is a single product. For example, a technique of providing an adiabatic structure of a refrigerator to be in a vacuum state has been disclosed in U.S. Patent Laid-Open Publication No. US 2004/0226956 A1 (Reference Document 3).

However, it is difficult to obtain an adiabatic effect of a practical level by providing the walls of the refrigerator to be in a sufficient vacuum state. Specifically, it is difficult to prevent heat transfer at a contact portion between external and internal cases having different temperatures. Further, it is difficult to maintain a stable vacuum state. Furthermore, it is difficult to prevent deformation of the cases due to a sound pressure in the vacuum state. Due to these problems, the technique of Reference Document 3 is limited to cryogenic refrigerating apparatuses, and is not applied to refrigerating apparatuses used in general households.

Technical Problem

Embodiments provide a vacuum adiabatic body and a refrigerator, which can obtain a sufficient adiabatic effect in a vacuum state and be applied commercially. Embodiments also provide a vacuum adiabatic body in which the position of a conductive resistance sheet provided in the vacuum adiabatic body is optimized, thereby improving adiabatic performance.

Technical Solution

In one embodiment, a vacuum adiabatic body includes: a first plate member defining at least one portion of a wall for a first space; a second plate member defining at least one portion of a wall for a second space having a different temperature from the first space; a sealing part sealing the first plate member and the second plate member to provide a third space that has a temperature between the temperature of the first space and the temperature of the second space and is in a vacuum state; a supporting unit maintaining the third space; a heat resistance unit for decreasing a heat transfer amount between the first plate member and the second plate member; and an exhaust port through which a gas in the third space is exhausted, wherein the heat resistance unit includes a conductive resistance sheet connected to the first plate member, the conductive resistance sheet resisting heat conduction flowing along a wall for the third space, the conductive resistance sheet includes a shielding part for heat-insulating the conductive resistance sheet by shielding one surface of the conductive resistance sheet, and the other surface of the conductive resistance sheet is heat-insulated by the third space.

In another embodiment, a vacuum adiabatic body includes: a first plate member defining at least one portion of a wall for a first space; a second plate member defining at least one portion of a wall for a second space having a different temperature from the first space; a sealing part sealing the first plate member and the second plate member to provide a third space that has a temperature between the temperature of the first space and the temperature of the second space and is in a vacuum state; a supporting unit maintaining the third space; a heat resistance unit for decreasing a heat transfer amount between the first plate member and the second plate member; and an exhaust port through which a gas in the third space is exhausted, wherein the heat resistance unit includes a conductive resistance sheet connected to the first plate member, the conductive resistance sheet resisting heat conduction flowing along a wall for the third space, a thickness of the conductive resistance sheet is thinner than the first and second plate members, and a shielding part for heat-insulating the conductive resistance sheet is provided at an outside of the conductive resistance sheet.

In still another embodiment, a refrigerator includes: a main body provided with an internal space in which storage goods are stored; and a door provided to open/close the main body from an external space, wherein, in order to supply a refrigerant into the main body, the refrigerator includes: a compressor for compressing the refrigerant; a condenser for condensing the compressed refrigerant; an expander for expanding the condensed refrigerant; and an evaporator for evaporating the expanded refrigerant to take heat, wherein at least one of the main body and the door includes a vacuum adiabatic body, wherein the vacuum adiabatic body includes: a first plate member defining at least one portion of a wall for the internal space; a second plate member defining at least one portion of a wall for the external space; a sealing part sealing the first plate member and the second plate member to provide a vacuum space part that has a temperature between a temperature of the internal space and a temperature of the external space and is in a vacuum state; a supporting unit maintaining the vacuum space part; a heat resistance unit for decreasing a heat transfer amount between the first plate member and the second plate member; and an exhaust port through which a gas in the vacuum space part is exhausted, wherein a shielding part for heat-insulating the conductive resistance sheet is provided at an outside of the conductive resistance sheet.

Advantageous Effects

According to the present disclosure, it is possible to provide a vacuum adiabatic body having a vacuum adiabatic effect and a refrigerator including the same.

MODE FOR INVENTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the disclosure may be practiced. These embodiments are described in sufficient detail to enable those skilled in the art to practice the disclosure, and it is understood that other embodiments may be utilized and that logical structural, mechanical, electrical, and chemical changes may be made without departing from the spirit or scope of the disclosure. To avoid detail not necessary to enable those skilled in the art to practice the disclosure, the description may omit certain information known to those skilled in the art. The following detailed description is, therefore, not to be taken in a limiting sense.

In the following description, the term 'vacuum pressure' means a certain pressure state lower than atmospheric pressure. In addition, the expression that a vacuum degree of A is higher than that of B means that a vacuum pressure of A is lower than that of B.

Figure 1:
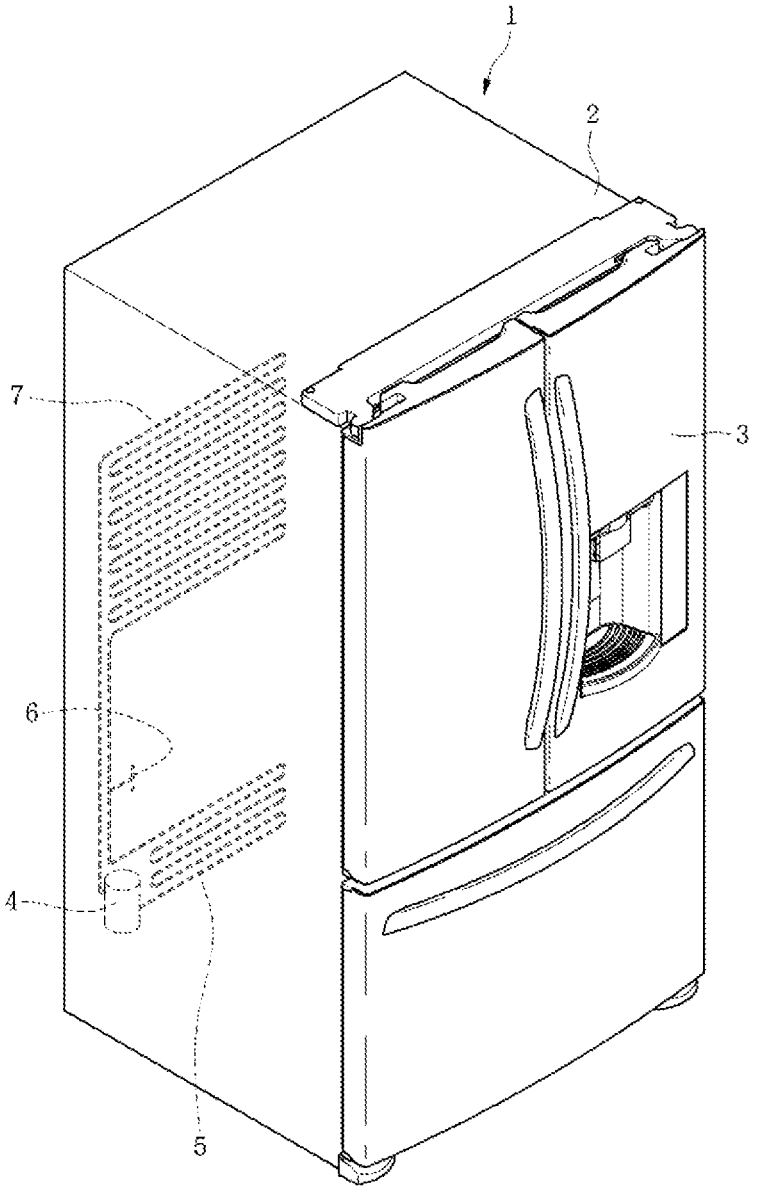
FIG. 1 is a perspective view of a refrigerator according to an embodiment.
Figure 2:
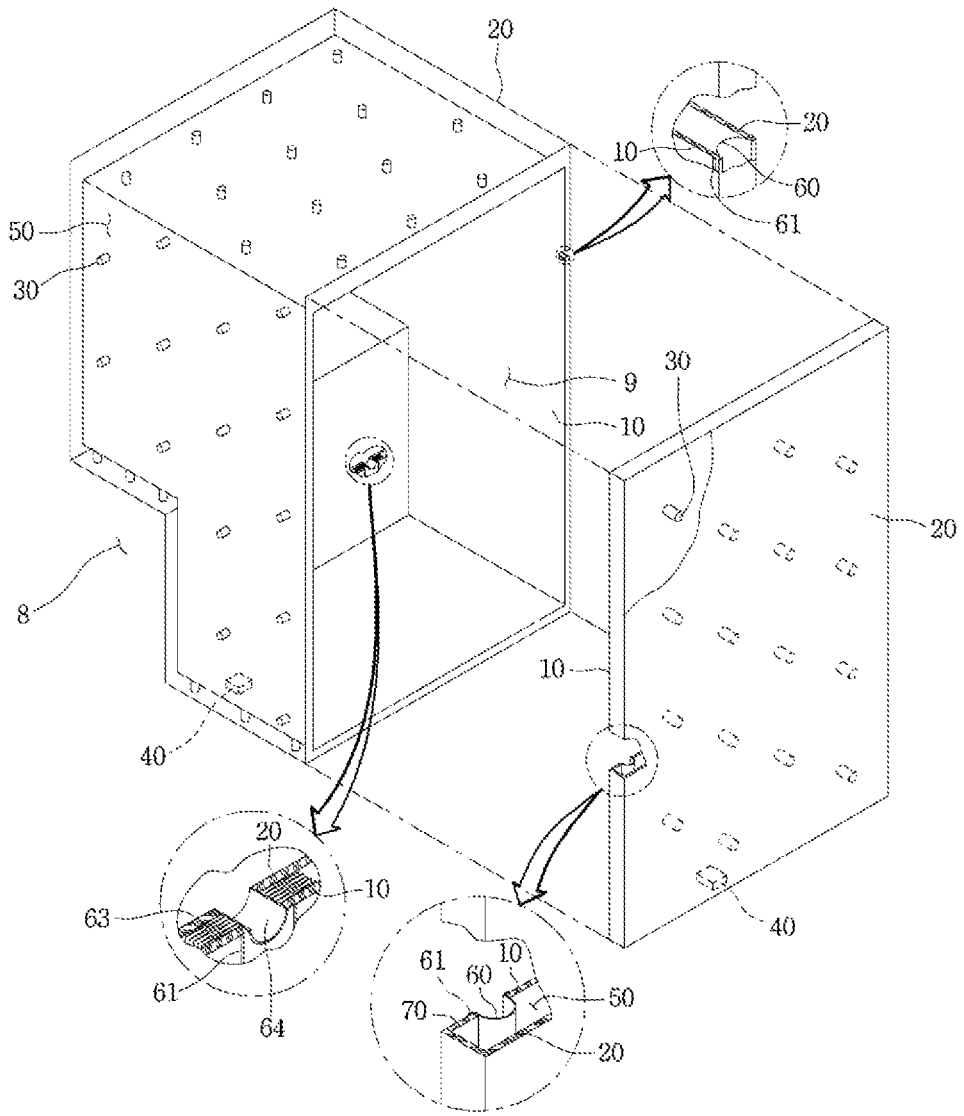
FIG. 2 is a view schematically showing a vacuum adiabatic body used in a main body and a door of the refrigerator.

FIG. 1 is a perspective view of a refrigerator according to an embodiment. FIG. 2 is a view schematically showing a vacuum adiabatic body used in the main body and the door of the refrigerator. In FIG. 2, a main body-side vacuum adiabatic body is illustrated in a state in which top and side walls are removed, and a door-side vacuum adiabatic body is illustrated in a state in which a portion of a front wall is removed. In addition, sections of portions at conductive resistance sheets are provided are schematically illustrated for convenience of understanding.

Referring to FIGS. 1 and 2, the refrigerator 1 includes a main body 2 provided with a cavity 9 capable of storing storage goods and a door 3 provided to open/close the main body 2. The door 3 may be rotatably or movably disposed to open/close the cavity 9. The cavity 9 may provide at least one of a refrigerating chamber and a freezing chamber.

Parts constituting a freezing cycle in which cold air is supplied into the cavity 9 may be included. Specifically, the parts include a compressor 4 for compressing a refrigerant, a condenser 5 for condensing the compressed refrigerant, an expander 6 for expanding the condensed refrigerant, and an evaporator 7 for evaporating the expanded refrigerant to take heat. As a typical structure, a fan may be installed at a position adjacent to the evaporator 7, and a fluid blown from the fan may pass through the evaporator 7 and then be blown into the cavity 9. A freezing load is controlled by adjusting the blowing amount and blowing direction by the fan, adjusting the amount of a circulated refrigerant, or adjusting the compression rate of the compressor, so that it is possible to control a refrigerating space or a freezing space.

The vacuum adiabatic body includes a first plate member (or first plate 10 for providing a wall of a low-temperature space, a second plate member (or second plate) 20 for providing a wall of a high-temperature space, and a vacuum space part (or vacuum space) 50 defined as a gap part between the first and second plate members 10 and 20. Also, the vacuum adiabatic body includes the conductive resistance sheets 60 and 62 for preventing heat conduction between the first and second plate members 10 and 20.

A sealing part (or seal) 61 for sealing the first and second plate members 10 and 20 is provided such that the vacuum space part 50 is in a sealing state. When the vacuum adiabatic body is applied to a refrigerating or heating cabinet, the first plate member 10 may be referred to as an inner case, and the second plate member 20 may be referred to as an outer case. A machine chamber 8 in which parts providing a freezing cycle are accommodated is placed at a lower rear side of the main body-side vacuum adiabatic body, and an exhaust port 40 for forming a vacuum state by exhausting air in the vacuum space part 50 is provided at any one side of the vacuum adiabatic body. In addition, a pipeline 64 passing through the vacuum space part 50 may be further installed so as to install a defrosting water line and electric lines.

The first plate member 10 may define at least one portion of a wall for a first space provided thereto. The second plate member 20 may define at least one portion of a wall for a second space provided thereto. The first space and the second space may be defined as spaces having different temperatures. Here, the wall for each space may serve as not only a wall directly contacting the space but also a wall not contacting the space. For example, the vacuum adiabatic body of the embodiment may also be applied to a product further having a separate wall contacting each space.

Factors of heat transfer, which cause loss of the adiabatic effect of the vacuum adiabatic body, are heat conduction between the first and second plate members 10 and 20, heat radiation between the first and second plate members 10 and 20, and gas conduction of the vacuum space part 50.

Hereinafter, a heat resistance unit provided to reduce adiabatic loss related to the factors of the heat transfer will be provided. Meanwhile, the vacuum adiabatic body and the refrigerator of the embodiment do not exclude that another adiabatic means is further provided to at least one side of the vacuum adiabatic body. Therefore, an adiabatic means using foaming or the like may be further provided to another side of the vacuum adiabatic body.

Figure 3:
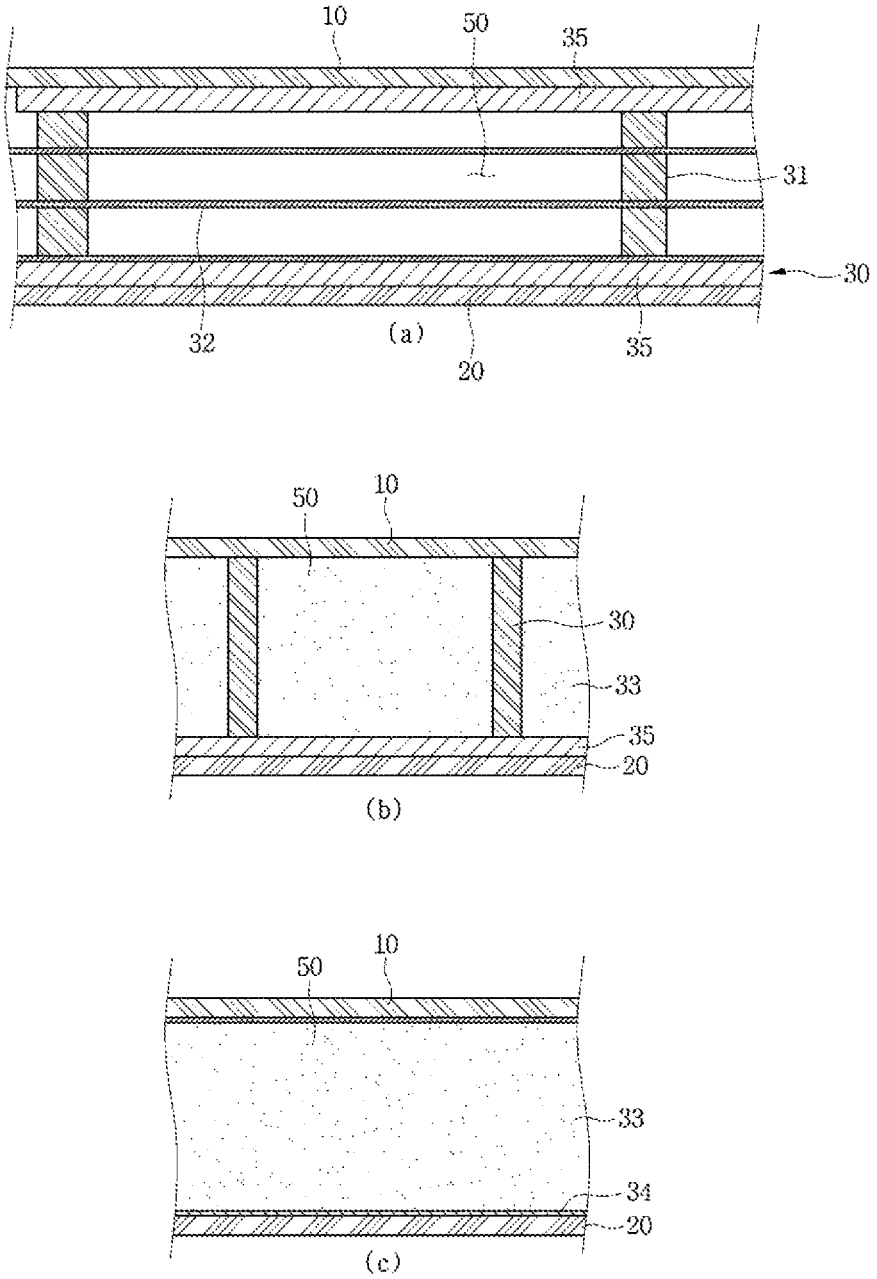
FIG. 3 is a view showing various embodiments of an internal configuration of a vacuum space part.

FIG. 3 is a view showing various embodiments of an internal configuration of the vacuum space part. First, referring to FIG. 3*a*, the vacuum space part 50 is provided in a third space having a different pressure from the first and second spaces, preferably, a vacuum state, thereby reducing adiabatic loss. The third space may be provided at a temperature between the temperature of the first space and the temperature of the second space. Since the third space is provided as a space in the vacuum state, the first and second plate members 10 and 20 receive a force contracting in a direction in which they approach each other due to a force corresponding to a pressure difference between the first and second spaces. Therefore, the vacuum space part 50 may be deformed in a direction in which it is reduced. In this case, adiabatic loss may be caused due to an increase in amount of heat radiation, caused by the contraction of the vacuum space part 50, and an increase in amount of heat conduction, caused by contact between the plate members 10 and 20.

A supporting unit (or support) 30 may be provided to reduce the deformation of the vacuum space part 50. The supporting unit 30 includes bars 31. The bars 31 may extend in a direction substantially vertical to the first and second plate members 10 and 20 so as to support a distance between the first and second plate members 10 and 20. A support plate 35 may be additionally provided to at least one end of the bar 31. The support plate 35 connects at least two bars 31 to each other, and may extend in a direction horizontal to the first and second plate members 10 and 20.

The support plate 35 may be provided in a plate shape, or may be provided in a lattice shape such that its area contacting the first or second plate member 10 or 20 is decreased, thereby reducing heat transfer. The bars 31 and the support plate 35 are fixed to each other at at least one portion, to be inserted together between the first and second plate members 10 and 20. The support plate 35 contacts at least one of the first and second plate members 10 and 20, thereby preventing deformation of the first and second plate members 10 and 20.

In addition, based on the extending direction of the bars 31, a total sectional area of the support plate 35 is provided to be greater than that of the bars 31, so that heat transferred through the bars 31 can be diffused through the support plate 35. A material of the supporting unit 30 may include a resin selected from the group consisting of PC, glass fiber PC, low outgassing PC, PPS, and LCP so as to obtain high compressive strength, low outgassing and water absorptance, low thermal conductivity, high compressive strength at high temperature, and excellent machinability.

A radiation resistance sheet 32 for reducing heat radiation between the first and second plate members 10 and 20 through the vacuum space part 50 will be described. The first and second plate members 10 and 20 may be made of a stainless material capable of preventing corrosion and providing a sufficient strength. The stainless material has a relatively high emissivity of 0.16, and hence a large amount of radiation heat may be transferred.

In addition, the supporting unit 30 made of the resin has a lower emissivity than the plate members, and is not entirely provided to inner surfaces of the first and second plate members 10 and 20. Hence, the supporting unit 30 does not have great influence on radiation heat. Therefore, the radiation resistance sheet 32 may be provided in a plate shape over a majority of the area of the vacuum space part 50 so as to concentrate on reduction of radiation heat transferred between the first and second plate members 10 and 20.

A product having a low emissivity may be preferably used as the material of the radiation resistance sheet 32. In an embodiment, an aluminum foil having an emissivity of 0.02 may be used as the radiation resistance sheet 32. Since the transfer of radiation heat cannot be sufficiently blocked using one radiation resistance sheet, at least two radiation resistance sheets 32 may be provided at a certain distance so as not to contact each other. In addition, at least one radiation resistance sheet may be provided in a state in which it contacts the inner surface of the first or second plate member 10 or 20.

Referring to FIG. 3*b*, the distance between the plate members is maintained by the supporting unit 30, and a porous material 33 may be filled in the vacuum space part 50. The porous material 33 may have a higher emissivity than the stainless material of the first and second plate members 10 and 20. However, since the porous material 33 is filled in the vacuum space part 50, the porous material 33 has a high efficiency for blocking the transfer of radiation heat. In this embodiment, the vacuum adiabatic body can be manufactured without using the radiation resistance sheet 32.

Referring to FIG. 3*c*, the supporting unit 30 maintaining the vacuum space part 50 is not provided. Instead of the supporting unit 30, the porous material 33 is provided in a state in which it is surrounded by a film 34. In this case, the porous material 33 may be provided in a state in which it is compressed so as to maintain the gap of the vacuum space part 50. The film 34 is made of, for example, a PE material, and may be provided in a state in which holes are formed therein.

In this embodiment, the vacuum adiabatic body can be manufactured without using the supporting unit 30. In other words, the porous material 33 can serve together as the radiation resistance sheet 32 and the supporting unit 30.

Figure 4:
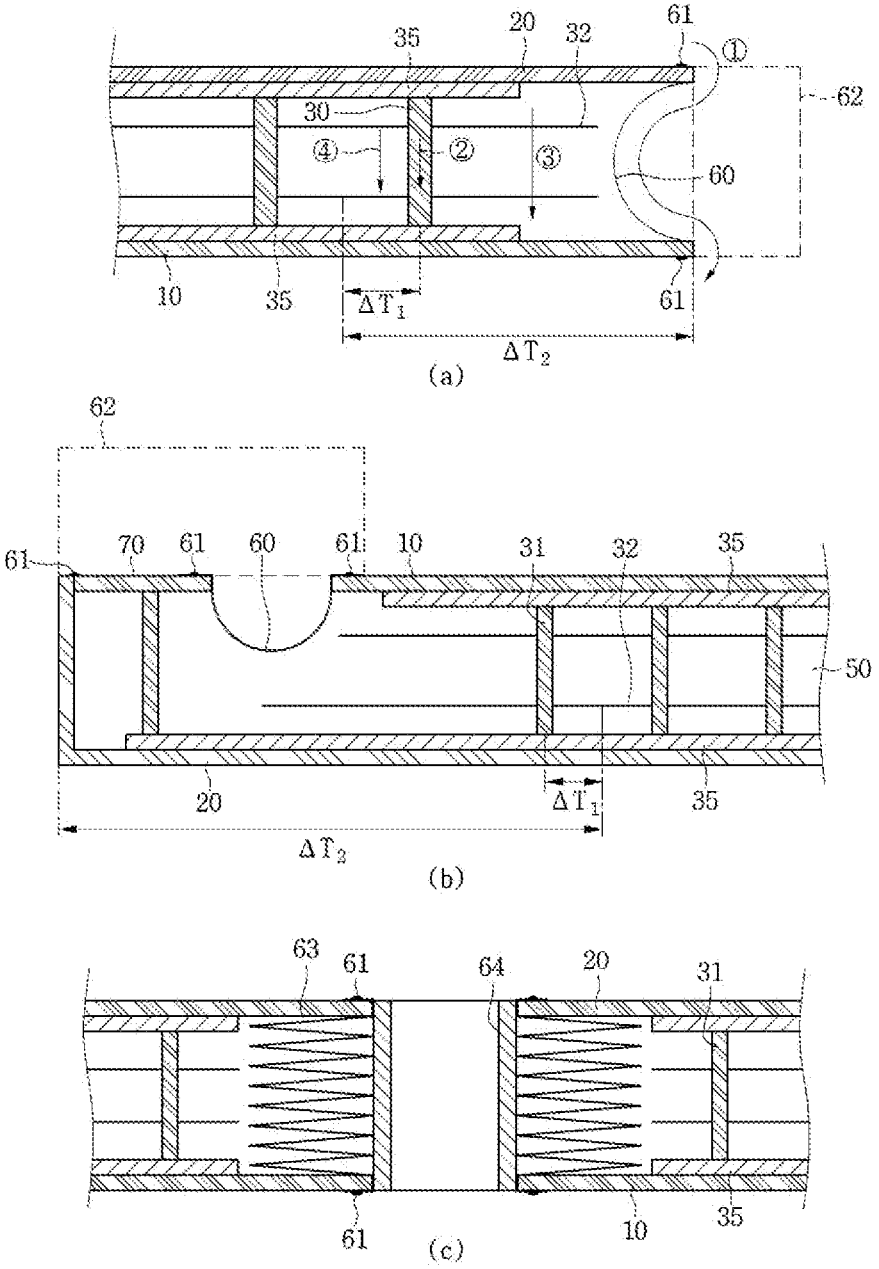
FIG. 4 is a view showing various embodiments of conductive resistance sheets and peripheral parts thereof.

FIG. 4 is a view showing various embodiments of the conductive resistance sheets and peripheral parts thereof. Structures of the conductive resistance sheets are briefly illustrated in FIG. 2, but will be understood in detail with reference to FIG. 4.

First, a conductive resistance sheet proposed in FIG. 4*a* may be preferably applied to the main body-side vacuum adiabatic body. Specifically, the first and second plate members 10 and 20 are to be sealed so as to vacuumize the interior of the vacuum adiabatic body. In this case, since the two plate members have different temperatures from each other, heat transfer may occur between the two plate members. A conductive resistance sheet 60 is provided to prevent heat conduction between two different kinds of plate members.

The conductive resistance sheet 60 may be provided with sealing parts 61 at which both ends of the conductive resistance sheet 60 are sealed to define at least one portion of the wall for the third space and maintain the vacuum state. The conductive resistance sheet 60 may be provided as a thin foil in units of micrometers so as to reduce the amount of heat conducted along the wall for the third space. The sealing parts 61 may be provided as welding parts. That is, the conductive resistance sheet 60 and the plate members 10 and 20 may be fused to each other.

In order to cause a fusing action between the conductive resistance sheet 60 and the plate members 10 and 20, the conductive resistance sheet 60 and the plate members 10 and 20 may be made of the same material, and a stainless material may be used as the material. The sealing parts 61 are not limited to the welding parts, and may be provided through a process such as cocking. The conductive resistance sheet 60 may be provided in a curved shape. Thus, a heat conduction distance of the conductive resistance sheet 60 is provided longer than the linear distance of each plate member, so that the amount of heat conduction can be further reduced.

A change in temperature occurs along the conductive resistance sheet 60. Therefore, in order to block heat transfer to the exterior of the conductive resistance sheet 60, a shielding part (or shield) 62 may be provided at the exterior of the conductive resistance sheet 60 such that an adiabatic action occurs. In other words, in the refrigerator, the second plate member 20 has a high temperature and the first plate member 10 has a low temperature. In addition, heat conduction from high temperature to low temperature occurs in the conductive resistance sheet 60, and hence the temperature of the conductive resistance sheet 60 is suddenly changed. Therefore, when the conductive resistance sheet 60 is opened to the exterior thereof, heat transfer through the opened place may seriously occur.

In order to reduce heat loss, the shielding part 62 is provided at the exterior of the conductive resistance sheet 60. For example, when the conductive resistance sheet 60 is exposed to any one of the low-temperature space and the high-temperature space, the conductive resistance sheet 60 does not serve as a conductive resistor as well as the exposed portion thereof, which is not preferable.

The shielding part 62 may be provided as a porous material contacting an outer surface of the conductive resistance sheet 60. The shielding part 62 may be provided as an adiabatic structure, e.g., a separate gasket, which is placed at the exterior of the conductive resistance sheet 60. The shielding part 62 may be provided as a portion of the vacuum adiabatic body, which is provided at a position facing a corresponding conductive resistance sheet 60 when the main body-side vacuum adiabatic body is closed with respect to the door-side vacuum adiabatic body. In order to reduce heat loss even when the main body and the door are opened, the shielding part 62 may be preferably provided as a porous material or a separate adiabatic structure.

A conductive resistance sheet proposed in FIG. 4*b* may be preferably applied to the door-side vacuum adiabatic body. In FIG. 4*b*, portions different from those of FIG. 4*a* are described in detail, and the same description is applied to portions identical to those of FIG. 4*a*. A side frame 70 is further provided at an outside of the conductive resistance sheet 60. A part for sealing between the door and the main body, an exhaust port necessary for an exhaust process, a getter port for vacuum maintenance, and the like may be placed on the side frame 70. This is because the mounting of parts is convenient in the main body-side vacuum adiabatic body, but the mounting positions of parts are limited in the door-side vacuum adiabatic body.

In the door-side vacuum adiabatic body, it is difficult to place the conductive resistance sheet 60 at a front end portion of the vacuum space part, i.e., a corner side portion of the vacuum space part. This is because, unlike the main body, a corner edge portion of the door is exposed to the exterior. More specifically, if the conductive resistance sheet 60 is placed at the front end portion of the vacuum space part, the corner edge portion of the door is exposed to the exterior, and hence there is a disadvantage in that a separate adiabatic part should be configured so as to improve the adiabatic performance of the conductive resistance sheet 60.

A conductive resistance sheet proposed in FIG. 4*c* may be preferably installed in the pipeline passing through the vacuum space part. In FIG. 4*c*, portions different from those of FIGS. 4*a* and 4*b* are described in detail, and the same description is applied to portions identical to those of FIGS. 4*a* and 4*b*. A conductive resistance sheet having the same shape as that of FIG. 4*a*, preferably, a wrinkled conductive resistance sheet 63 may be provided at a peripheral portion of the pipeline 64. Accordingly, a heat transfer path can be lengthened, and deformation caused by a pressure difference can be prevented. In addition, a separate shielding part may be provided to improve the adiabatic performance of the conductive resistance sheet.

A heat transfer path between the first and second plate members 10 and 20 will be described with reference back to FIG. 4*a*. Heat passing through the vacuum adiabatic body may be divided into surface conduction heat ① conducted along a surface of the vacuum adiabatic body, more specifically, the conductive resistance sheet 60, supporter conduction heat ② conducted along the supporting unit 30 provided inside the vacuum adiabatic body, gas conduction heat (or convection) ③ conducted through an internal gas in the vacuum space part, and radiation transfer heat ④ transferred through the vacuum space part.

The transfer heat may be changed depending on various design dimensions. For example, the supporting unit may be changed such that the first and second plate members 10 and 20 can endure a vacuum pressure without being deformed, the vacuum pressure may be changed, the distance between the plate members may be changed, and the length of the conductive resistance sheet may be changed. The transfer heat may be changed depending on a difference in temperature between the spaces (the first and second spaces) respectively provided by the plate members. In the embodiment, a preferred configuration of the vacuum adiabatic body has been found by considering that its total heat transfer amount is smaller than that of a typical adiabatic structure formed by foaming polyurethane. In a typical refrigerator including the adiabatic structure formed by foaming the polyurethane, an effective heat transfer coefficient may be proposed as 19.6 mW/mK.

By performing a relative analysis on heat transfer amounts of the vacuum adiabatic body of the embodiment, a heat transfer amount by the gas conduction heat can become smallest. For example, the heat transfer amount by the gas conduction heat ③ may be controlled to be equal to or smaller than 4% of the total heat transfer amount. A heat transfer amount by solid conduction heat defined as a sum of the surface conduction heat ① and the supporter conduction heat ② is largest. For example, the heat transfer amount by the solid conduction heat may reach 75% of the total heat transfer amount. A heat transfer amount by the radiation transfer heat ④ is smaller than the heat transfer amount by the solid conduction heat but larger than the heat transfer amount of the gas conduction heat ③. For example, the heat transfer amount by the radiation transfer heat ④ may occupy about 20% of the total heat transfer amount.

According to such a heat transfer distribution, effective heat transfer coefficients (eK: effective K) (W/mK) of the surface conduction heat ①, the supporter conduction heat ②, the gas conduction heat ③, and the radiation transfer heat ④ may have an order of Math FIG. 1.

$$eK_{solidconductionheat} > eK_{radiationtransferheat} > eK_{gasconductionheat} \quad \text{[Math FIG. 1]}$$

Here, the effective heat transfer coefficient (eK) is a value that can be measured using a shape and temperature differences of a target product. The effective heat transfer coefficient (eK) is a value that can be obtained by measuring a total heat transfer amount and a temperature of at least one portion at which heat is transferred. For example, a calorific value (W) is measured using a heating source that can be quantitatively measured in the refrigerator, a temperature distribution (K) of the door is measured using heats respectively transferred through a main body and an edge of the door of the refrigerator, and a path through which heat is transferred is calculated as a conversion value (m), thereby evaluating an effective heat transfer coefficient.

The effective heat transfer coefficient (eK) of the entire vacuum adiabatic body is a value given by $k=QL/A\Delta T$. Here, Q denotes a calorific value (W) and may be obtained using a calorific value of a heater. A denotes a sectional area (m2) of the vacuum adiabatic body, L denotes a thickness (m) of the vacuum adiabatic body, and ΔT denotes a temperature difference.

For the surface conduction heat, a conductive calorific value may be obtained through a temperature difference (ΔT) between an entrance and an exit of the conductive resistance sheet 60 or 63, a sectional area (A) of the conductive resistance sheet, a length (L) of the conductive resistance sheet, and a thermal conductivity (k) of the conductive resistance sheet (the thermal conductivity of the conductive resistance sheet is a material property of a material and can be obtained in advance). For the supporter conduction heat, a conductive calorific value may be obtained through a temperature difference (ΔT) between an entrance and an exit of the supporting unit 30, a sectional area (A) of the supporting unit, a length (L) of the supporting unit, and a thermal conductivity (k) of the supporting unit.

Here, the thermal conductivity of the supporting unit is a material property of a material and can be obtained in advance. The sum of the gas conduction heat ③ and the radiation transfer heat ④ may be obtained by subtracting the surface conduction heat and the supporter conduction heat from the heat transfer amount of the entire vacuum adiabatic body. A ratio of the gas conduction heat ③ and the radiation transfer heat ④ may be obtained by evaluating radiation transfer heat when no gas conduction heat exists by remarkably lowering a vacuum degree of the vacuum space part 50.

When a porous material is provided inside the vacuum space part 50, porous material conduction heat ⑤ may be a sum of the supporter conduction heat ② and the radiation transfer heat ④. The porous material conduction heat ⑤ may be changed depending on various variables including a kind, an amount, and the like of the porous material.

According to an embodiment, a temperature difference ΔT1 between a geometric center formed by adjacent bars 31 and a point at which each of the bars 31 is located may be preferably provided to be less than 0.5° C. Also, a temperature difference ΔT2 between the geometric center formed by the adjacent bars 31 and an edge portion of the vacuum adiabatic body may be preferably provided to be less than 0.5° C. In the second plate member 20, a temperature difference between an average temperature of the second plate and a temperature at a point at which a heat transfer path passing through the conductive resistance sheet 60 or 63 meets the second plate may be largest.

For example, when the second space is a region hotter than the first space, the temperature at the point at which the heat transfer path passing through the conductive resistance sheet meets the second plate member becomes lowest. Similarly, when the second space is a region colder than the first space, the temperature at the point at which the heat transfer path passing through the conductive resistance sheet meets the second plate member becomes highest.

This means that the amount of heat transferred through other points except the surface conduction heat passing through the conductive resistance sheet should be controlled, and the entire heat transfer amount satisfying the vacuum adiabatic body can be achieved only when the surface conduction heat occupies the largest heat transfer amount. To this end, a temperature variation of the conductive resistance sheet may be controlled to be larger than that of the plate member.

Physical characteristics of the parts constituting the vacuum adiabatic body will be described. In the vacuum adiabatic body, a force by vacuum pressure is applied to all of the parts. Therefore, a material having a strength (N/m2) of a certain level may be preferably used.

Under such circumferences, the plate members 10 and 20 and the side frame 70 may be preferably made of a material having a sufficient strength with which they are not damaged by even vacuum pressure. For example, when the number of bars 31 is decreased so as to limit the support conduction heat, deformation of the plate member occurs due to the vacuum pressure, which may be a bad influence on the external appearance of refrigerator. The radiation resistance sheet 32 may be preferably made of a material that has a low emissivity and can be easily subjected to thin film processing. Also, the radiation resistance sheet 32 is to ensure a strength high enough not to be deformed by an external impact. The supporting unit 30 is provided with a strength high enough to support the force by the vacuum pressure and endure an external impact, and is to have machinability. The conductive resistance sheet 60 may be preferably made of a material that has a thin plate shape and can endure the vacuum pressure.

In an embodiment, the plate member, the side frame, and the conductive resistance sheet may be made of stainless materials having the same strength. The radiation resistance sheet may be made of aluminum having a weaker strength that the stainless materials. The supporting unit may be made of resin having a weaker strength than the aluminum.

Unlike the strength from the point of view of materials, analysis from the point of view of stiffness is required. The stiffness (N/m) is a property that would not be easily deformed. Although the same material is used, its stiffness may be changed depending on its shape. The conductive resistance sheets 60 or 63 may be made of a material having a predetermined strength, but the stiffness of the material is preferably low so as to increase heat resistance and minimize radiation heat as the conductive resistance sheet is uniformly spread without any roughness when the vacuum pressure is applied. The radiation resistance sheet 32 requires a stiffness of a certain level so as not to contact another part due to deformation. Particularly, an edge portion of the radiation resistance sheet may generate conduction heat due to drooping caused by the self-load of the radiation resistance sheet. Therefore, a stiffness of a certain level is required. The supporting unit 30 requires a stiffness high enough to endure a compressive stress from the plate member and an external impact.

In an embodiment, the plate member and the side frame may preferably have the highest stiffness so as to prevent deformation caused by the vacuum pressure. The supporting unit, particularly, the bar may preferably have the second highest stiffness. The radiation resistance sheet may preferably have a stiffness that is lower than that of the supporting unit but higher than that of the conductive resistance sheet.

The conductive resistance sheet may be preferably made of a material that is easily deformed by the vacuum pressure and has the lowest stiffness. Even when the porous material 33 is filled in the vacuum space part 50, the conductive resistance sheet may preferably have the lowest stiffness, and the plate member and the side frame may preferably have the highest stiffness.

Hereinafter, a vacuum pressure preferably determined depending on an internal state of the vacuum adiabatic body will be described. As already described above, a vacuum pressure is to be maintained inside the vacuum adiabatic body so as to reduce heat transfer. At this time, it will be easily expected that the vacuum pressure is preferably maintained as low as possible so as to reduce the heat transfer.

The vacuum space part 50 may resist the heat transfer by applying only the supporting unit 30. Alternatively, the porous material 33 may be filled together with the supporting unit in the vacuum space part 50 to resist the heat transfer. Alternatively, the vacuum space part may resist the heat transfer not by applying the supporting unit but by applying the porous material 33.

Figure 5:
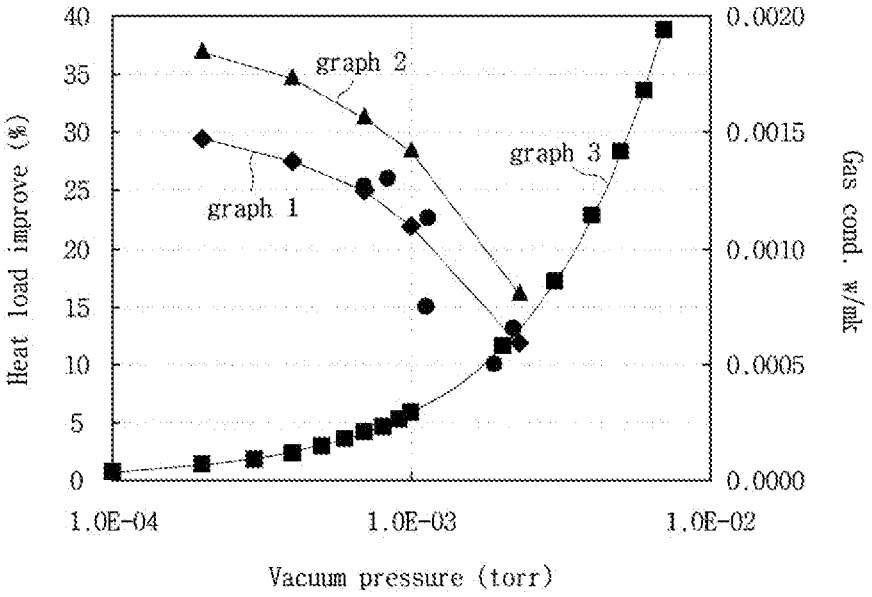
FIG. 5 illustrates graphs showing changes in adiabatic performance and changes in gas conductivity with respect to vacuum pressures by applying a simulation.

The case where only the supporting unit is applied will be described. FIG. 5 illustrates graphs showing changes in adiabatic performance and changes in gas conductivity with respect to vacuum pressures by applying a simulation. Referring to FIG. 5, it can be seen that, as the vacuum pressure is decreased, i.e., as the vacuum degree is increased, a heat load in the case of only the main body (Graph 1) or in the case where the main body and the door are joined together (Graph 2) is decreased as compared with that in the case of the typical product formed by foaming polyurethane, thereby improving the adiabatic performance. However, it can be seen that the degree of improvement of the adiabatic performance is gradually lowered. Also, it can be seen that, as the vacuum pressure is decreased, the gas conductivity (Graph 3) is decreased.

However, it can be seen that, although the vacuum pressure is decreased, the ratio at which the adiabatic performance and the gas conductivity are improved is gradually lowered. Therefore, it is preferable that the vacuum pressure is decreased as low as possible. However, it takes long time to obtain excessive vacuum pressure, and much cost is consumed due to excessive use of a getter. In the embodiment, an optimal vacuum pressure is proposed from the above-described point of view.

Figure 6:
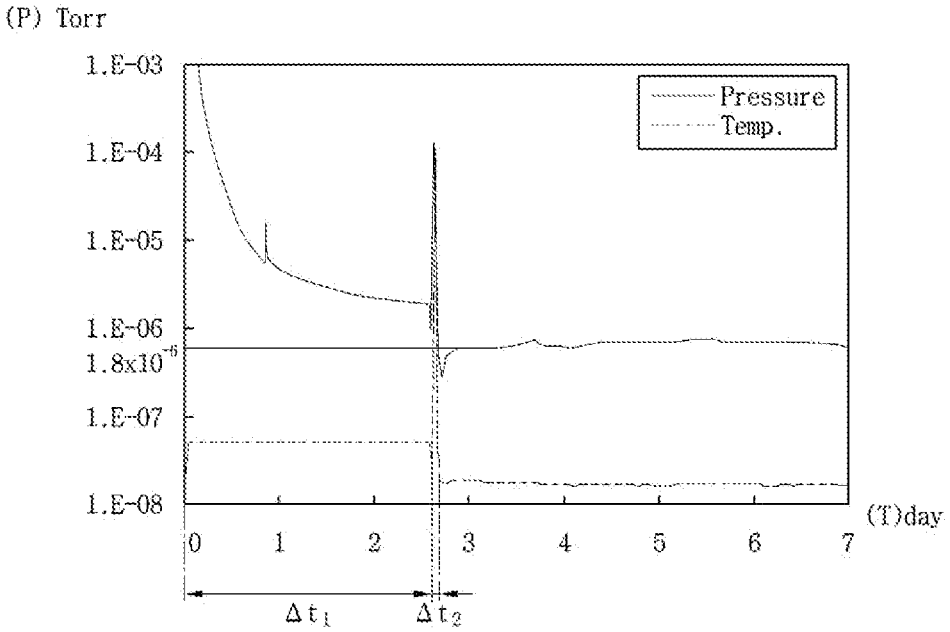
FIG. 6 illustrates graphs obtained by observing, over time and pressure, a process of exhausting the interior of the vacuum adiabatic body when a supporting unit is used.

FIG. 6 illustrates graphs obtained by observing, over time and pressure, a process of exhausting the interior of the vacuum adiabatic body when the supporting unit is used. Referring to FIG. 6, in order to create the vacuum space part 50 to be in the vacuum state, a gas in the vacuum space part 50 is exhausted by a vacuum pump while evaporating a latent gas remaining in the parts of the vacuum space part 50 through baking. However, if the vacuum pressure reaches a certain level or more, there exists a point at which the level of the vacuum pressure is not increased any more (Δt1).

After that, the getter is activated by disconnecting the vacuum space part 50 from the vacuum pump and applying heat to the vacuum space part 50 (Δt2). If the getter is activated, the pressure in the vacuum space part 50 is decreased for a certain period of time, but then normalized to maintain a vacuum pressure of a certain level. The vacuum pressure that maintains the certain level after the activation of the getter is approximately 1.8×10^(−6) Torr. In the embodiment, a point at which the vacuum pressure is not substantially decreased any more even though the gas is exhausted by operating the vacuum pump is set to the lowest limit of the vacuum pressure used in the vacuum adiabatic body, thereby setting the minimum internal pressure of the vacuum space part 50 to 1.8×10^(−6) Torr.

Figure 7:
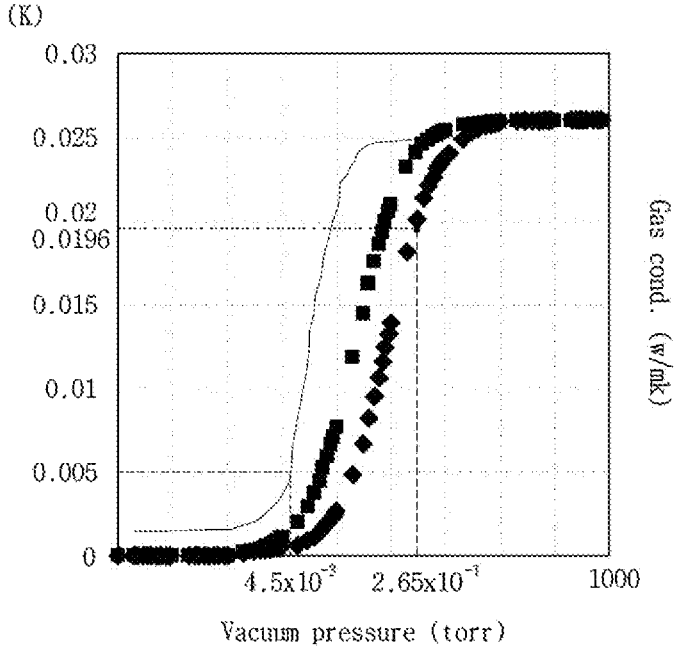
FIG. 7 illustrates graphs obtained by comparing vacuum pressures and gas conductivities.

FIG. 7 illustrates graphs obtained by comparing vacuum pressures and gas conductivities. Referring to FIG. 7, gas conductivities with respect to vacuum pressures depending on sizes of a gap in the vacuum space part 50 are represented as graphs of effective heat transfer coefficients (eK). Effective heat transfer coefficients (eK) were measured when the gap in the vacuum space part 50 has three sizes of 2.76 mm, 6.5 mm, and 12.5 mm.

The gap in the vacuum space part 50 is defined as follows. When the radiation resistance sheet 32 exists inside vacuum space part 50, the gap is a distance between the radiation resistance sheet 32 and the plate member adjacent thereto. When the radiation resistance sheet 32 does not exist inside vacuum space part 50, the gap is a distance between the first and second plate members.

It can be seen that, since the size of the gap is small at a point corresponding to a typical effective heat transfer coefficient of 0.0196 W/mK, which is provided to an adiabatic material formed by foaming polyurethane, the vacuum pressure is 2.65×10^(−1) Torr even when the size of the gap is 2.76 mm. Meanwhile, it can be seen that the point at which reduction in adiabatic effect caused by gas conduction heat is saturated even though the vacuum pressure is decreased is a point at which the vacuum pressure is approximately 4.5×10◯(−3) Torr. The vacuum pressure of 4.5×10◯(−3) Torr can be defined as the point at which the reduction in adiabatic effect caused by gas conduction heat is saturated. Also, when the effective heat transfer coefficient is 0.1 W/mK, the vacuum pressure is 1.2×10^(−2) Torr.

When the vacuum space part 50 is not provided with the supporting unit but provided with the porous material, the size of the gap ranges from a few micrometers to a few hundredths of micrometers. In this case, the amount of radiation heat transfer is small due to the porous material even when the vacuum pressure is relatively high, i.e., when the vacuum degree is low. Therefore, an appropriate vacuum pump is used to adjust the vacuum pressure. The vacuum pressure appropriate to the corresponding vacuum pump is approximately 2.0×10^(−4) Torr.

Also, the vacuum pressure at the point at which the reduction in adiabatic effect caused by gas conduction heat is saturated is approximately 4.7×10^(−2) Torr. Also, the pressure where the reduction in adiabatic effect caused by gas conduction heat reaches the typical effective heat transfer coefficient of 0.0196 W/mK is 730 Torr. When the supporting unit and the porous material are provided together in the vacuum space part, a vacuum pressure may be created and used, which is middle between the vacuum pressure when only the supporting unit is used and the vacuum pressure when only the porous material is used.

Figure 8:
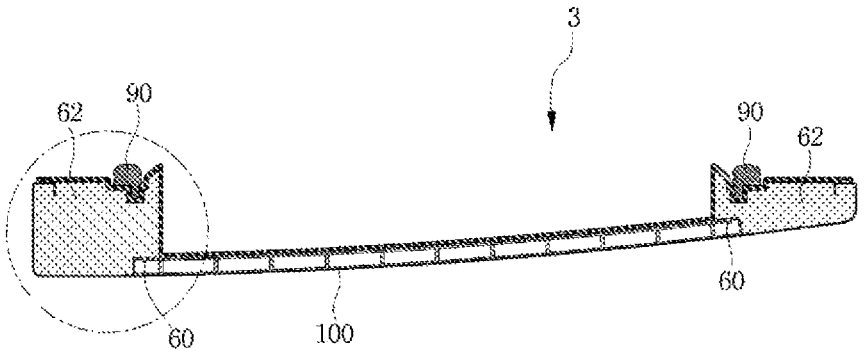
FIG. 8 is a section view of the door of FIG. 1.
Figure 9:
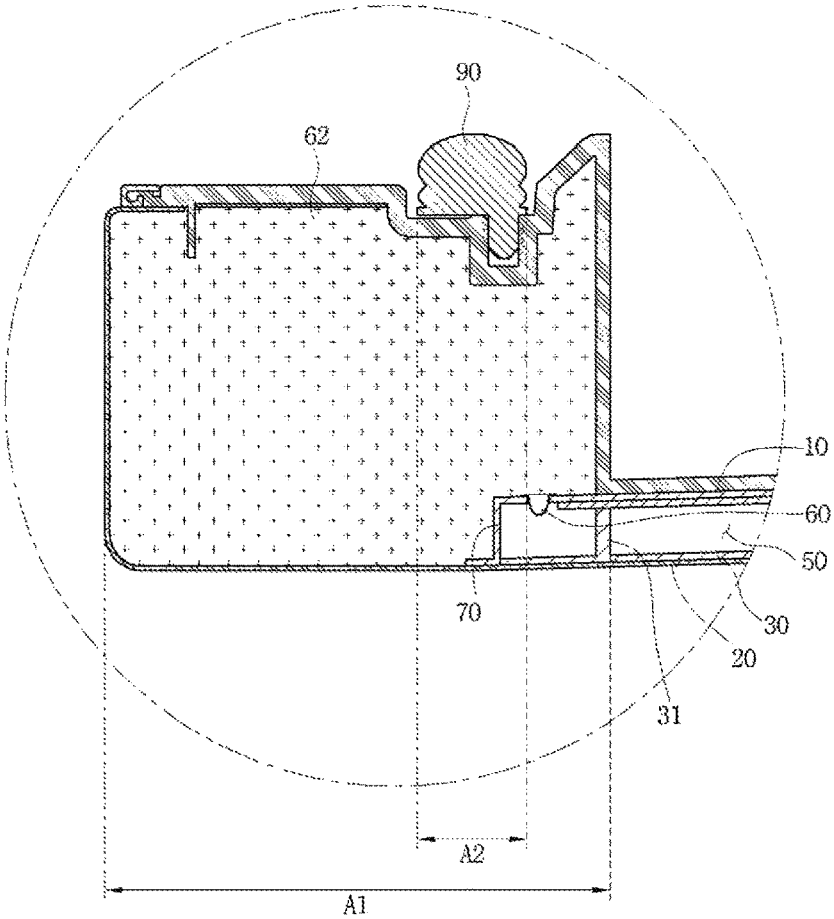
FIG. 9 is an enlarged view of FIG. 8.

FIG. 8 is a section view of the door of FIG. 1, and FIG. 9 is an enlarged view of FIG. 8. Referring to FIGS. 8 and 9, the door 3 may include a vacuum adiabatic body 100 and a shielding part (or shield) 62 provided at an edge of the vacuum adiabatic body 100.

The vacuum adiabatic body 100 may include, as parts that enables a vacuum space part to be separated from an external atmospheric space, a first plate member (or first plate) 10, a second plate member (or second plate) 20, a conductive resistance sheet 60, and a side frame 70. The vacuum adiabatic body 100 may include a supporting unit (or support) 30 for maintaining a distance between the first plate member 10 and the second plate member 20, and the supporting unit 30 may include a bar 31.

The side frame 70 may be formed in a bent shape. One side of the side frame 70 may be connected to the conductive resistance sheet 60, and the other side of the side frame 70 may be connected to the second plate member 20.

The second plate member 20 and the conductive resistance sheet 60 may be coupled to the side frame 70 through welding. The side frame 70 is shielded by the shielding part 62, thereby insulating heat.

In the refrigerator, cold air passing through the conductive resistance sheet 60 is transferred to the side frame 70. The temperature of the side plate 70 is formed relatively higher than that of the first plate member 10.

The shielding part 62 shields an upper portion of the conductive resistance sheet 60, thereby heat-insulating the conductive resistance sheet 60. Meanwhile, a lower portion of the conductive resistance sheet 60 may be heat-insulated by the vacuum space part 50. The shielding part 62 may be formed along the edge of the vacuum adiabatic body 100.

The shielding part 62 may include a porous material, etc. so as to improve an adiabatic effect. Specifically, the shielding part 62 may include a polyurethane material.

A gasket 90 may be provided at an upper end of the shielding part 62. The gasket 90 blocks a gap between the door 3 and the main body 2, thereby blocking convection heat transfer between the interior and exterior of the refrigerator. A lower end of the shielding part 62 contacts the conductive resistance sheet 60 at at least one portion, and the upper end of the shielding part 62 contacts the gasket 90.

The conductive resistance sheet 60 is disposed at a position A1 at which it overlaps with the shielding part 62, which is effective in heat insulation. If the conductive resistance sheet 60 is out of the position A1, the adiabatic effect may be decreased.

Furthermore, if the conductive resistance sheet 60 is disposed at a position A2 at which it overlaps with the gasket 90, the adiabatic effect may be further increased. A result obtained by analyzing heat transfer with respect to positions of the conductive resistance sheet 60 will be described in detail with reference to FIG. 10.

A curved surface depressed toward the vacuum space part 50 is formed in the conductive resistance sheet 60. At this time, the curved surface is disposed at the position A2 at which it overlaps with the gasket 90, which is most preferable from the point of view of heat insulation.

Although not shown in these figures, the conductive resistance sheet 60 may include a sealing part for fastening the conductive resistance sheet 60 to the first plate member 10. In this case, the sealing part may be disposed at the position A2 at which it overlaps with the gasket 90.

Meanwhile, when the vacuum adiabatic body at the side of the main body 2 is closed with respect to the vacuum adiabatic body at the side of the door 3, the conductive resistance sheet 60 provided in the door 3 is shielded by the vacuum adiabatic body provided in the main body 2, thereby insulating heat. In this case, adiabatic performance can be optimized when the conductive resistance sheet 60 provided in the door 3 is disposed at a position at which it overlaps with the vacuum adiabatic body provided in the main body 2.

On the contrary, the conductive resistance sheet provided in the main body 2 is shielded by the door 3, thereby insulating heat. In this case, adiabatic performance can be optimized when the conductive resistance sheet provided in the main body is disposed at a position at which it overlaps with the vacuum adiabatic body 60 provided in the door 3.

Figure 10:
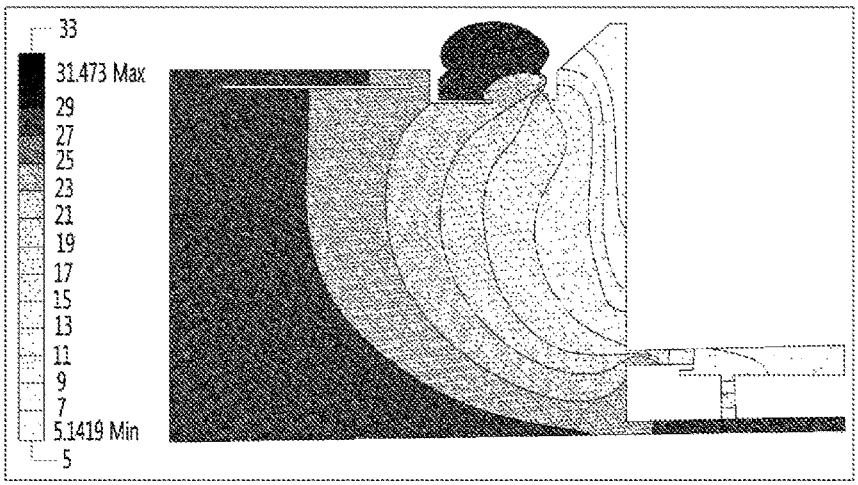
FIG. 10 is a view showing a result obtained by analyzing heat transfer when the conductive resistance sheet is disposed at an outside of a shielding part.

Hereinafter, a result obtained by analyzing heat transfer with respect to positions of the conductive resistance sheet 60 will be described. FIG. 10 is a view showing a result obtained by analyzing heat transfer when the conductive resistance sheet is disposed at an outside of the shielding part.

Referring to FIG. 10, it can be seen that, when the conductive resistance sheet 60 is disposed at the outside of the shielding part, the temperature of a portion of the outer surface of the shielding part 62 is lowered. Specifically, it can be seen through the analysis that a middle point of a side portion of the shielding part 62 has a lower temperature than other portions. Also, it can be seen that the temperature of a front portion of the shielding part 62 is lowered as the front portion reaches from the left side to the right side.

This is because cold air in the refrigerator is transferred to the exterior as the adiabatic performance between the first plate member 10 and the second plate member 20 is degraded. If the temperature of the outer surface of the shielding part 62 is lowered to fall to a dew point, a dew condensation phenomenon may occur, and therefore, a customer's inconvenience may be caused.

Figure 11:
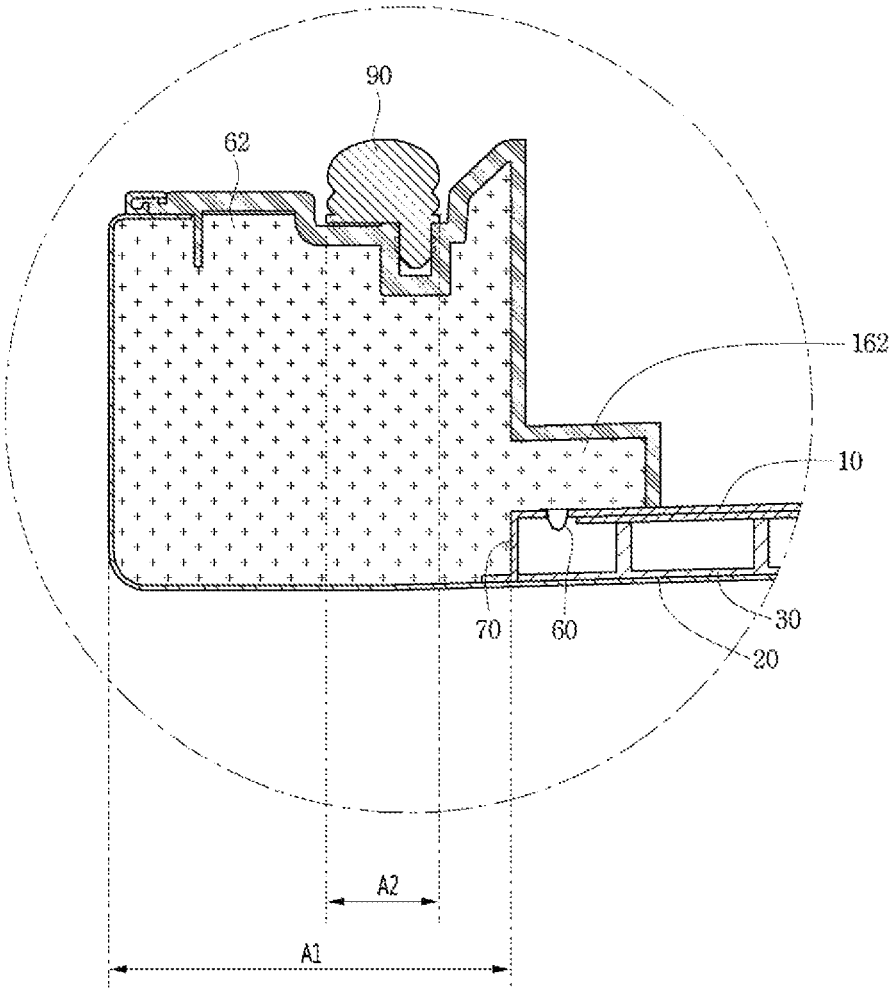
FIG. 11 is a sectional view of a door according to another embodiment.

Hereinafter, a structure for heat-insulating the conductive resistance sheet 60 placed at the outside of the shielding part 62 will be described. FIG. 11 is a sectional view of a door according to another embodiment. This embodiment is different from the above-described embodiment only in the shielding part and the conductive resistance sheet, and therefore, overlapping descriptions will be omitted.

Referring to FIG. 11, the door of this embodiment includes a first plate member 10, a second plate member 20, a supporting unit 30, a conductive resistance sheet 60, and a side frame 70. A shielding part 62 may be provided at the periphery of the side frame 70, and a gasket 90 may be provided at an upper side of the shielding part 62.

The conductive resistance sheet 60 is disposed at an outside of the shielding part 62. That is, the conductive resistance sheet 60 may be exposed to the interior of the refrigerator. However, the shielding part 62 may include an adiabatic extending part (or adiabatic extension) 162.

The adiabatic extending part 162 is formed to extend toward the inside of the first plate member 10 from the shielding part 62, thereby shielding the conductive resistance sheet 60. That is, the separate adiabatic extending part 162 is added without deforming the shielding part 62, so that it is possible to shield the conductive resistance sheet 60. The conductive resistance sheet 60 is shielded by the adiabatic extending part 162, so that it is possible to improve the adiabatic performance of the vacuum adiabatic body.

Figure 12:
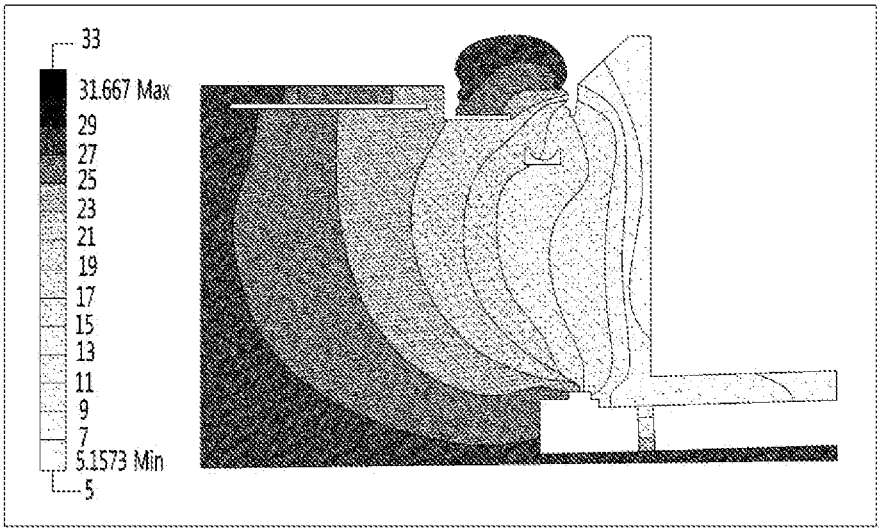
FIGS. 12 to 14 are views showing results obtained by analyzing heat transfer with respect to positions of the conductive resistance sheet.
Figure 13:
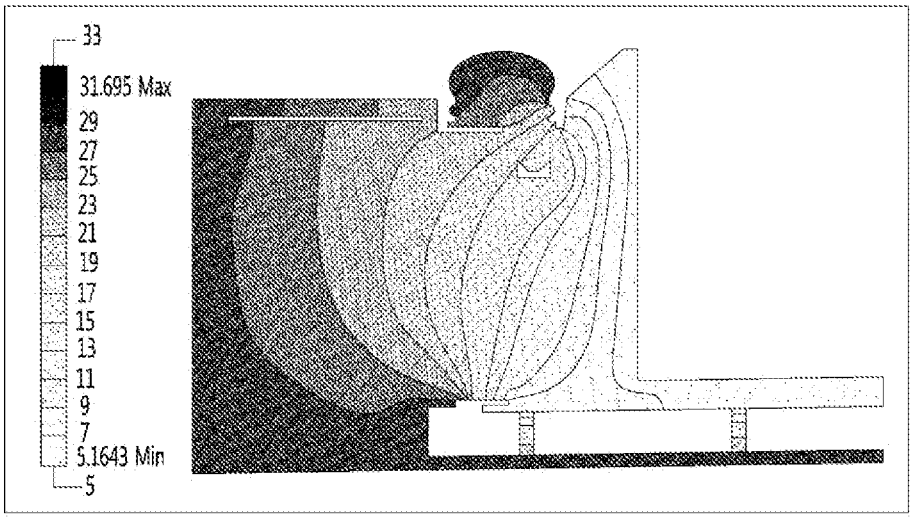
Figure 14:
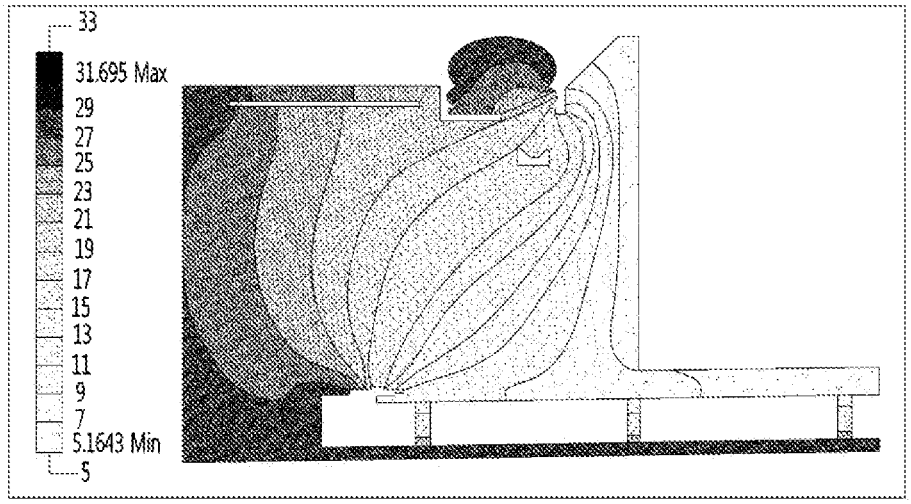

FIGS. 12 to 14 are views showing results obtained by analyzing heat transfer with respect to positions of the conductive resistance sheet. FIG. 12 illustrates a case where the conductive resistance sheet is disposed inside the shielding part, FIG. 13 illustrates a case where the conductive resistance sheet is disposed at a position at which it overlaps with the gasket, and FIG. 14 illustrates a case where the conductive resistance sheet overlaps with the shielding part but does not overlap with the gasket.

Referring to FIG. 12, there is shown a temperature gradient when the conductive resistance sheet 60 is disposed at an inside of the shielding part 62, i.e., position A1. In FIG. 12, it can be seen that the temperature gradient of the shielding part 62 is formed with a uniform thickness. That is, it can be seen that, as the conductive resistance sheet 60 is heat-insulated, cold air in the refrigerator is prevented from being transferred to the exterior.

Referring to FIG. 13, there is shown a temperature gradient when the conductive resistance sheet 60 is disposed at a position at which it overlaps with the gasket 90 while being disposed at the inside of the shielding part 62. That is, there is shown a temperature gradient when the conductive resistance sheet 60 is disposed at position A2.

It can be seen that the temperature of the outer surface of the shielding part 62 is uniform even when the conductive resistance sheet 60 is disposed at the position at which it overlaps with the gasket 90. That is, it can be seen that, as the conductive resistance sheet 60 is heat-insulated, cold air in the refrigerator is prevented from being transferred to the exterior.

The case of FIG. 13 will be compared with the case of FIG. 12. In the case of FIG. 13, the temperature gradient is rapidly changed in the vicinity of the conductive resistance sheet 60. On the other hand, in the case of FIG. 12, the temperature gradient is gently changed in the vicinity of the conductive resistance sheet 60. That the temperature gradient is rapidly changed means that heat transfer in the vicinity of the conductive resistance sheet 60 is limited as much as the change in temperature gradient. Accordingly, the adiabatic performance can be estimated.

In the case of FIG. 13, the range in which the temperature is constantly maintained toward the inside from the outer surface of the shielding part 62 is wide. On the other hand, in the case of FIG. 12, the range in which the temperature is constantly maintained toward the inside from the outer surface of the shielding part 62 is narrow.

Referring to FIG. 14, there is a temperature gradient when the conductive resistance sheet 60 is disposed inside the shielding part 62. However, unlike the case of FIG. 12, FIG. 14 illustrates a case where the conductive resistance sheet 60 is disposed at a position distant from the gasket 90.

In this case, it can be seen that cold air is infiltrated deeply into the inside of the shielding part 62. Also, it can be seen that a temperature gradient occurs at an outer surface of the side portion of the shielding part 62. That is, it can be seen that the temperature of the surface is not uniform. Therefore, a dew condensation phenomenon may occur due to a temperature difference on an outer surface of the second plate member 20.

Figure 15:
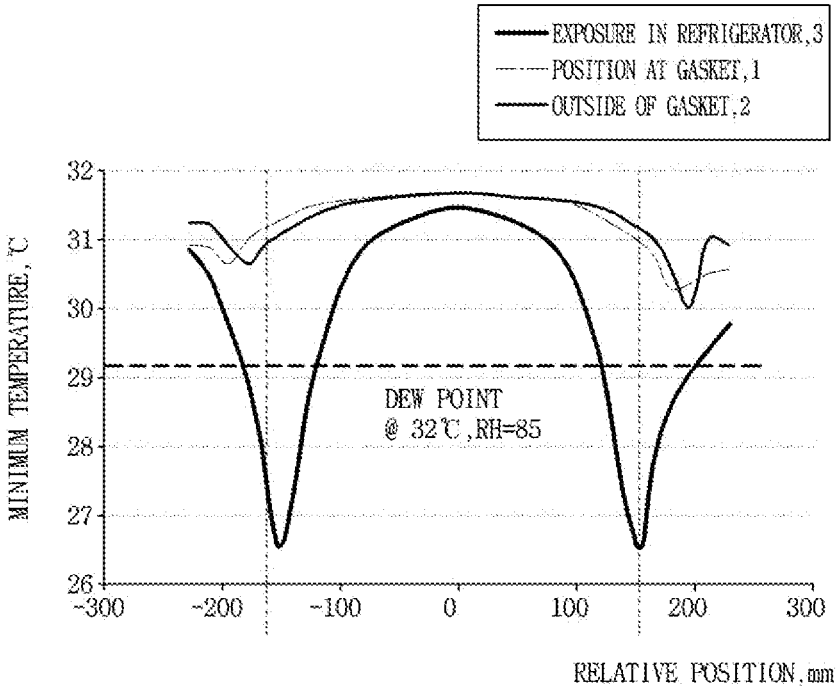
FIGS. 15 and 16 are graphs showing minimum temperatures of an outer surface of a second plate member with respect to relative positions of the conductive resistance sheet.
Figure 16:
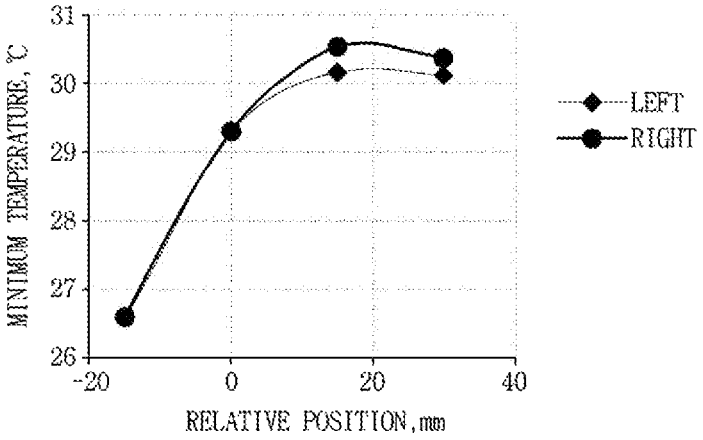

FIGS. 15 and 16 are graphs showing minimum temperatures of the outer surface of the second plate member with respect to relative positions of the conductive resistance sheet. Referring to FIGS. 15 and 16, it can be seen that a minimum temperature distribution of temperatures of the outer surface of the second plate member 20 when the conductive resistance sheet 60 is disposed at a position (first position) at which it overlaps with the gasket 90 is similar to a minimum temperature distribution of temperatures of the outer surface of the second plate member 20 when the conductive resistance sheet 60 is disposed at a position (second position) at which it is disposed in the shielding part 62 but does not overlap with the gasket 90.

However, it can be seen that, for some points, the temperature of the outer surface of the second plate member 20 when the conductive resistance sheet 60 is disposed at the second position is lower than the temperature of the outer surface of the second plate member 20 when the conductive resistance sheet 60 is disposed at the first position. Meanwhile, it can be seen that a temperature of the outer surface of the second plate member 20 when the conductive resistance sheet 60 is disposed at a position (third position) at which it is exposed in the refrigerator is remarkably low as compared with when the conductive resistance sheet 60 is disposed at the first position and when the conductive resistance sheet 60 is disposed at the second position. If the temperature of the outer surface of the second plate member 20 becomes lower than the dew point of air as it is lowered, dew may be condensed on the outer surface of the second plate member 20.

In the graph of FIG. 15, there is shown a dew point at a temperature of 32° C. and a relative humidity (RH) of 85%. It can be seen that, when the conductive resistance sheet 60 is disposed at the third position, surface temperatures falls to the dew point or less at some points of the outer surface of the second plate member 20. As described above, it is possible to prevent a phenomenon in which the temperature of the outer surface of the second plate member 20 is lowered by the cold air in the refrigerator by changing the position of the conductive resistance sheet 60.

Figure 17:
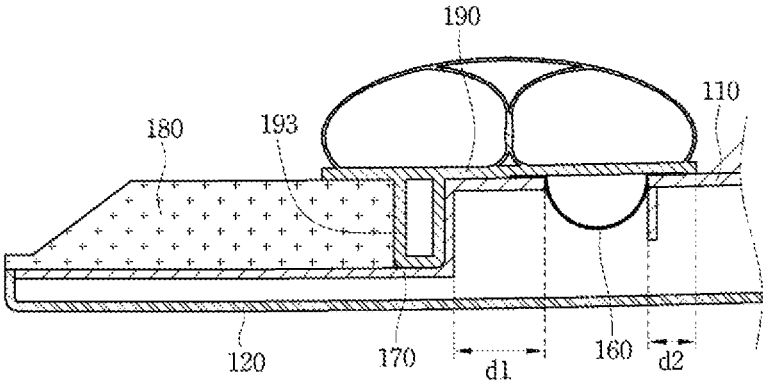
FIG. 17 is a sectional view of a door according to still another embodiment.

FIG. 17 is a sectional view of a door according to still another embodiment. Referring to FIG. 17, the door according to the embodiment may include a first plate member (or first plate) 110, a second plate member (or second plate) 120, a conductive resistance sheet 160, a side frame 170, and a gasket 190.

One side of the conductive resistance sheet 160 may be connected to the first plate member 110, and the other side of the conductive resistance sheet 160 may be connected to the side frame 170. The side frame 170 may be connected to the second plate member 120 at an outermost portion thereof. The side frame 170 may be coupled to the second plate member 120 through welding.

The side frame 170 may be formed in a bent shape. Specifically, the side frame 170 may be provided such that the height of an edge portion of the side frame 170 is lowered when viewed from the entire shape of the vacuum adiabatic body.

The conductive resistance sheet 160 may be mounted on a portion at which the height of the side frame 170 is high to be coupled to the side frame 170. The side frame 170 and the conductive resistance sheet 160 may be coupled to each other through welding.

An additional mounting part 180 may be mounted on a portion at which the height of the side frame 170 is low. A door hinge, an exhaust portion, etc. may be mounted on the addition mounting part 180. Accordingly, it is possible to maximally ensure the internal volume of a product such as the refrigerator provided by the vacuum adiabatic body, to improve an adiabatic effect, and to sufficiently ensure functions of the product.

The gasket 190 may completely shield the conductive resistance sheet 160. A protruding part 193 provided in the gasket 190 may be inserted in a space between the side frame 170 and the addition mounting part 180. Also, the gasket 190 may be mounted on a portion of the addition mounting part 180.

A length d1 of the portion at which the height of the side frame 170 is high may be formed longer than a length d2 from an edge portion of the first plate member 110 to an inner end of the gasket 190. That is, the gasket 190 is disposed at a position biased toward the side frame 170 so as to prevent cold air from being transferred from the first plate member 110 to the conductive resistance sheet 160. Similarly, a contact area between the gasket 190 and the side frame 170 may be formed wider than that between the gasket 190 and the first plate member 110.

The vacuum adiabatic body proposed in the present disclosure may be preferably applied to refrigerators. However, the application of the vacuum adiabatic body is not limited to the refrigerators, and may be applied in various apparatuses such as cryogenic refrigerating apparatuses, heating apparatuses, and ventilation apparatuses.

According to the present disclosure, the vacuum adiabatic body can be industrially applied to various adiabatic apparatuses. The adiabatic effect can be enhanced, so that it is possible to improve energy use efficiency and to increase the effective volume of an apparatus.

The invention claimed is:

1. A vacuum adiabatic body comprising:

a first plate defining at least one portion of a first side of a wall adjacent to a first space having a first temperature;

a second plate defining at least one portion of a second side of the wall adjacent to a second space having a second temperature different from the first temperature, the second side of the wall being nearer to the second space than the first side of the wall;

a first seal that seals the first plate and the second plate to provide a third space that has a third temperature between the first temperature and the second temperature and is in a vacuum state;

a conductive resistance sheet having a first end connected to at least one of the first plate and the second plate, the conductive resistance sheet configured to resist heat transfer between the second space and the first space;

a shield provided adjacent to the conductive resistance sheet; and a gasket provided to the shield, wherein a first surface of the conductive resistance sheet is heat-insulated by the shield provided adjacent to the conductive resistance sheet, a second surface of the conductive resistance sheet is heat-insulated by the third space, and wherein a side frame is provided between the conductive resistance sheet and the second plate, and the side frame is to provide at least one portion of the wall and to define part of the third space, wherein the side frame includes a first portion connected to a second end of the conductive resistance sheet, a second portion connected to the second plate, and a bent portion connected between the first portion and the second portion, wherein the bent portion includes a first surface to face the third space, and a second surface to face the shield.

2. The vacuum adiabatic body according to claim 1, wherein a first surface of the shield contacts the conductive resistance sheet, and a second surface of the shield contacts the gasket.

3. The vacuum adiabatic body according to claim 1, wherein the gasket heat-insulates the conductive resistance sheet.

4. The vacuum adiabatic body according to claim 2, further including a second seal that fastens the conductive resistance sheet to the first plate, wherein the second seal is provided such that the conductive resistance sheet overlaps with the gasket.

5. The vacuum adiabatic body according to claim 1, wherein the shield includes a porous material.

6. The vacuum adiabatic body according to claim 1, wherein the shield includes an adiabatic material made of a polyurethane material.

7. The vacuum adiabatic body according to claim 1, wherein the shield includes an adiabatic extension that extends toward a center of the first plate, the adiabatic extension shielding the conductive resistance sheet.

8. The vacuum adiabatic body according to claim 1, further including a support that supports the first and second plates and is provided in the third space.

9. The vacuum adiabatic body according to claim 1, further including an exhaust port through which a gas in the third space is exhausted.

10. A vacuum adiabatic body comprising:

a first plate defining at least one portion of a first side of a wall adjacent to a first space having a first temperature;

a second plate defining at least one portion of a second side of the wall adjacent to a second space having a second temperature different from the first temperature, the second side of the wall being nearer to the second space than the first side of the wall;

a seal that seals the first plate and the second plate to provide a third space that has a third temperature between the first temperature and the second temperature and is in a vacuum state;

a conductive resistance sheet having a first end connected to at least one of the first plate and the second plate, the conductive resistance sheet configured to resist heat transfer between the second space and the first space;

a shield provided adjacent to the conductive resistance sheet; and a gasket provided to the shield, wherein a first surface of the conductive resistance sheet is heat-insulated by the shield provided adjacent to the conductive resistance sheet, and a second surface of the conductive resistance sheet is heat-insulated by the third space, wherein a first surface of the shield contacts the conductive resistance sheet, and a second surface of the shield contacts the gasket, wherein at least one portion of the conductive resistance sheet overlaps with the gasket.

11. A vacuum adiabatic body comprising:

a first plate defining at least one portion of a first side of a wall adjacent to a first space having a first temperature;

a second plate defining at least one portion of a second side of the wall adjacent to a second space having a second temperature different from the first temperature, the second side of the wall being nearer to the second space than the first side of the wall;

a seal that seals the first plate and the second plate to provide a third space that has a third temperature between the first temperature and the second temperature and is in a vacuum state;

a conductive resistance sheet having a first end connected to at least one of the first plate and the second plate, the conductive resistance sheet configured to resist heat transfer between the second space and the first space;

a shield provided adjacent to the conductive resistance sheet; and a gasket provided to the shield, wherein a first surface of the conductive resistance sheet is heat-insulated by the shield provided adjacent to the conductive resistance sheet, and a second surface of the conductive resistance sheet is heat-insulated by the third space, wherein a first surface of the shield contacts the conductive resistance sheet, and a second surface of the shield contacts the gasket, wherein the conductive resistance sheet is depressed into the third space, and overlaps with the gasket.

12. A vacuum adiabatic body comprising:

a first plate defining at least one portion of a first side of a wall adjacent to a first space having a first temperature;

a second plate defining at least one portion of a second side of the wall adjacent to a second space having a second temperature different from the first temperature, the second side of the wall being nearer to the second space than the first side of the wall;

a first seal that seals the first plate and the second plate to provide a third space that has a third temperature between the first temperature and the second temperature and is in a vacuum state;

a conductive resistance sheet having a first end connected to at least one of the first plate and the second plate, the conductive resistance sheet configured to resist heat transfer between the second space and the first space;

a shield provided adjacent to the conductive resistance sheet; and a gasket provided to the shield, wherein a first surface of the conductive resistance sheet is heat-insulated by the shield provided adjacent to the conductive resistance sheet, and a second surface of the conductive resistance sheet is heat-insulated by the third space, the vacuum adiabatic body further comprising a second seal that fastens the conductive resistance sheet to the first plate, wherein the second seal is provided such that the conductive resistance sheet overlaps with the gasket.

13. The vacuum adiabatic body according to claim 12, wherein the shield includes an adiabatic material made of a polyurethane material.

14. The vacuum adiabatic body according to claim 12, wherein the gasket heat-insulates the conductive resistance sheet.

15. The vacuum adiabatic body according to claim 12, wherein a first surface of the shield contacts the conductive resistance sheet, and a second surface of the shield contacts the gasket.

* * * * *